United States Patent [19]

Rosenzweig

[11] 4,244,578

[45] Jan. 13, 1981

[54] ELECTRONIC BACKGAMMON

[76] Inventor: Walter L. Rosenzweig, 23 Willets Ave., Syosset, N.Y. 11791

[21] Appl. No.: 653,529

[22] Filed: Jan. 29, 1976

[51] Int. Cl.[3] ..... A63F 3/02

[52] U.S. Cl. ..... 273/237; 273/138 A

[58] Field of Search ..... 273/1 E, 54 C, 130 AB, 273/131 A, 134 A, 135 A, 136 A, 138 A; 235/92 GA; 340/323 R, 324 R, 324 AD, 172.5

[56] References Cited

U.S. PATENT DOCUMENTS

| | | | |
|---|---|---|---|
| D. 238,289 | 12/1975 | Regensburg | 273/136 H X |
| 3,189,888 | 6/1965 | Bradley | 340/323 R |
| 3,275,322 | 9/1966 | Burnside | 273/138 A |
| 3,654,392 | 4/1972 | Beinhocker et al. | 273/237 |
| 3,778,058 | 12/1973 | Rausch | 273/85 R |
| 3,796,433 | 3/1974 | Fraley et al. | 273/138 A |
| 3,874,669 | 4/1975 | Ariano | 273/85 R |
| 3,888,491 | 6/1975 | Bernard et al. | 273/136 A |
| 3,902,723 | 9/1975 | Colling et al. | 273/1 E X |
| 4,019,745 | 4/1977 | Mustelier | 273/237 |
| 4,026,555 | 5/1977 | Kirschner et al. | 273/85 G |

OTHER PUBLICATIONS

*Popular Science;* "Games Computers Play"; vol. 197, No. 4, Oct. 1976; p. 44.

*101 Basic Computer Games;* "MNOPLY"; Digital Equipment Corp.; Mar. 1975; pp. 1, 2, 153–155.

*Electronics;* "Scamp Microprocessor Aims to Replace Mechanical Logic;" Sep. 1975; pp. 81–87.

*Primary Examiner*—Vance Y. Hum

*Attorney, Agent, or Firm*—Phillips, Moore, Weissenberger, Lempio & Majestic

[57] ABSTRACT

A game of backgammon played electronically in which movement of men by the players is limited to switch controls exclusively. A memory stores signals representing the number of men of each player at each of the game positions and these signals are used to energize light emitting diodes on a console to display the positions of the men. The memory is updated each time a player moves a man to store signals representing the changed positions. Control circuitry in the console, in accordance with the rules of the game, (1) moves a man of one player from an initial game position to a final game position, (2) moves a man of the other player on the final position to the 0 position of this other player if this other player has only one man on the final position, and (3) prevents the one player from moving a man to the final position if the other player has at least two men on the final position. The console includes additional light emitting diodes which are controlled by the circuitry to be sequentially energized to display movement of a man from the initial position to the final position. Electronic dice are activated by push buttons and display on the console the number of positions a player may move his men. The game also includes a points doubling logic circuit which includes a numeric display on the console as the multiplier of the number of points being played for and push buttons enabling each player to double the number displayed each time a button is depressed, thereby doubling the points.

3 Claims, 13 Drawing Figures

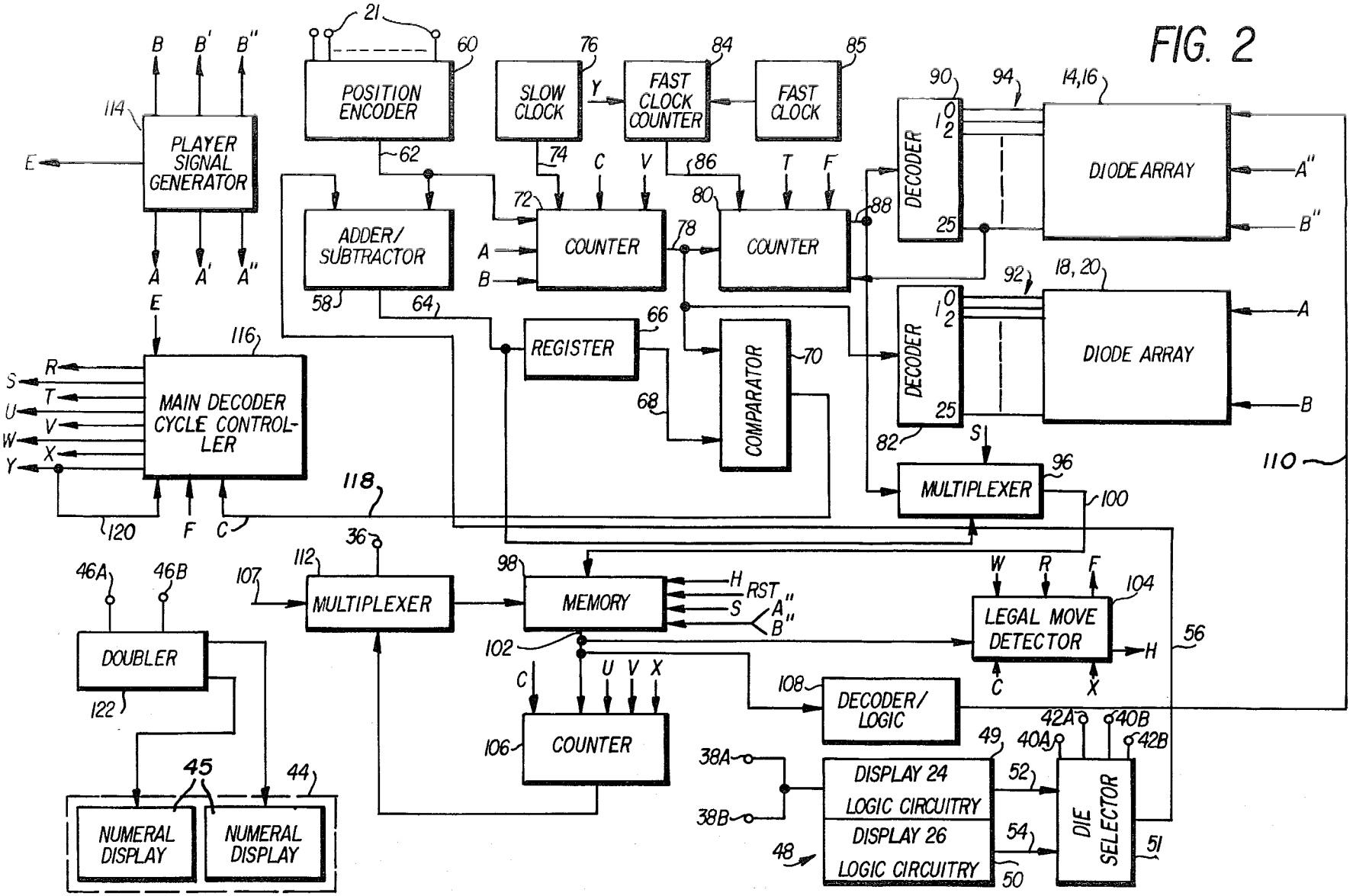
FIG. 2
DIODE ARRAY
DIODE ARRAY
DECODER
DECODER
MULTIPLEXER
LEGAL MOVE DETECTOR
DIE SELECTOR
DISPLAY 24 LOGIC CIRCUITRY
DISPLAY 26 LOGIC CIRCUITRY
DECODER/ LOGIC
FAST CLOCK
FAST CLOCK COUNTER
SLOW CLOCK
COUNTER
COUNTER
COMPARATOR
REGISTER
MEMORY
COUNTER
POSITION ENCODER
ADDER/ SUBTRACTOR
MULTIPLEXER
PLAYER SIGNAL GENERATOR
MAIN DECODER CYCLE CONTROL-LER
DOUBLER
NUMERAL DISPLAY
NUMERAL DISPLAY

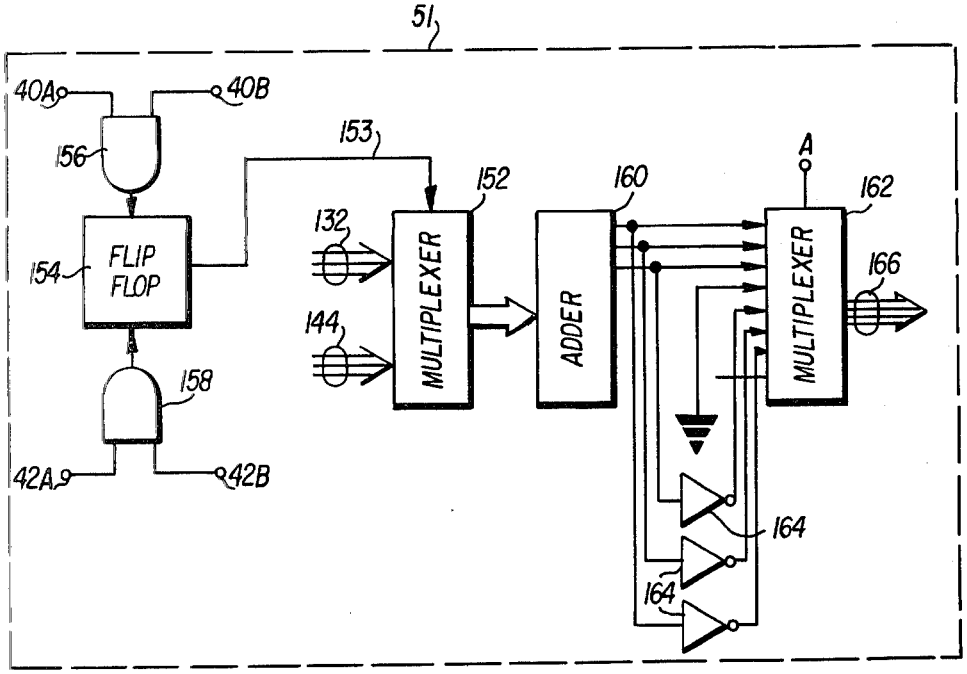
FIG. 3B
FIG. 4
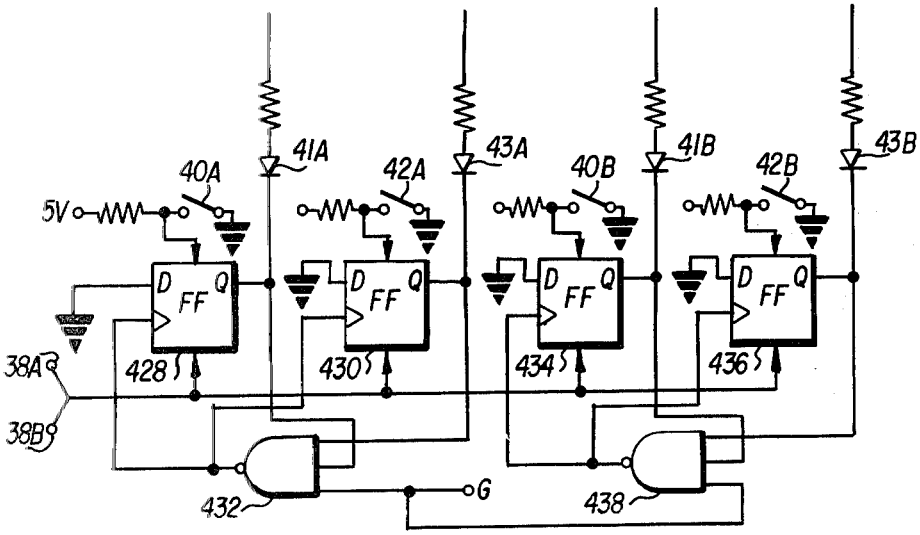

TRUTH TABLE I

| DECODER INPUT | | | DECODER OUTPUT | | | | | | DICE OUTPUT (0=ON, 1=OFF) | | | | | | |
|---|---|---|---|---|---|---|---|---|---|---|---|---|---|---|---|
| | | | $Y_0$ | $Y_1$ | $Y_2$ | $Y_3$ | $Y_4$ | $Y_5$ | A | B | C | D | E | F | G |
| 0 | 0 | 0 | 0 | 1 | 1 | 1 | 1 | 1 | 0 | 1 | 1 | 1 | 1 | 1 | 1 |
| 0 | 0 | 1 | 1 | 0 | 1 | 1 | 1 | 1 | 1 | 0 | 1 | 0 | 1 | 1 | 1 |
| 0 | 1 | 0 | 1 | 1 | 0 | 1 | 1 | 1 | 0 | 0 | 1 | 0 | 1 | 1 | 1 |
| 0 | 1 | 1 | 1 | 1 | 1 | 0 | 1 | 1 | 1 | 0 | 0 | 0 | 0 | 1 | 1 |
| 1 | 0 | 0 | 1 | 1 | 1 | 1 | 0 | 1 | 0 | 0 | 0 | 0 | 0 | 1 | 1 |
| 1 | 0 | 1 | 1 | 1 | 1 | 1 | 1 | 0 | 1 | 0 | 0 | 0 | 0 | 0 | 0 |

TRUTH TABLE II 0=OFF 1=ON

| DECODER INPUT | DECODER OUTPUT 0 | 1 | 2 | 3 | 4 | 5 | 6 | 7 | 8 | 9 | 10 | 11 | 12 | 13 | 14 | 15 | # OF MEN LIT | | | | | |
|---|---|---|---|---|---|---|---|---|---|---|---|---|---|---|---|---|---|---|---|---|---|---|
| 0 0 0 0 | 0 | 1 | 1 | 1 | 1 | 1 | 1 | 1 | 1 | 1 | 1 | 1 | 1 | 1 | 1 | 1 | 0 | 0 | 0 | 0 | 0 | 0 |
| 0 0 0 1 | 1 | 0 | 1 | 1 | 1 | 1 | 1 | 1 | 1 | 1 | 1 | 1 | 1 | 1 | 1 | 1 | 1 | 0 | 0 | 0 | 0 | 0 |
| 0 0 1 0 | 1 | 1 | 0 | 1 | 1 | 1 | 1 | 1 | 1 | 1 | 1 | 1 | 1 | 1 | 1 | 1 | 1 | 1 | 0 | 0 | 0 | 0 |
| 0 0 1 1 | 1 | 1 | 1 | 0 | 1 | 1 | 1 | 1 | 1 | 1 | 1 | 1 | 1 | 1 | 1 | 1 | 1 | 1 | 1 | 0 | 0 | 0 |
| 0 1 0 0 | 1 | 1 | 1 | 1 | 0 | 1 | 1 | 1 | 1 | 1 | 1 | 1 | 1 | 1 | 1 | 1 | 1 | 1 | 1 | 1 | 0 | 0 |
| 0 1 0 1 | 1 | 1 | 1 | 1 | 1 | 0 | 1 | 1 | 1 | 1 | 1 | 1 | 1 | 1 | 1 | 1 | 1 | 1 | 1 | 1 | 1 | 0 |
| 0 1 1 0 | 1 | 1 | 1 | 1 | 1 | 1 | 0 | 1 | 1 | 1 | 1 | 1 | 1 | 1 | 1 | 1 | 1 | 1 | 1 | 1 | 1 | 1 |
| 0 1 1 1 | 1 | 1 | 1 | 1 | 1 | 1 | 1 | 0 | 1 | 1 | 1 | 1 | 1 | 1 | 1 | 1 | 1 | 0 | 0 | 0 | 0 | 1 |
| 1 0 0 0 | 1 | 1 | 1 | 1 | 1 | 1 | 1 | 1 | 0 | 1 | 1 | 1 | 1 | 1 | 1 | 1 | 1 | 1 | 0 | 0 | 0 | 1 |
| 1 0 0 1 | 1 | 1 | 1 | 1 | 1 | 1 | 1 | 1 | 1 | 0 | 1 | 1 | 1 | 1 | 1 | 1 | 1 | 1 | 1 | 0 | 0 | 1 |
| 1 0 1 0 | 1 | 1 | 1 | 1 | 1 | 1 | 1 | 1 | 1 | 1 | 0 | 1 | 1 | 1 | 1 | 1 | 1 | 1 | 1 | 1 | 0 | 1 |
| 1 0 1 1 | 1 | 1 | 1 | 1 | 1 | 1 | 1 | 1 | 1 | 1 | 1 | 0 | 1 | 1 | 1 | 1 | 0 | 0 | 0 | 0 | 1 | 1 |
| 1 1 0 0 | 1 | 1 | 1 | 1 | 1 | 1 | 1 | 1 | 1 | 1 | 1 | 1 | 0 | 1 | 1 | 1 | 1 | 0 | 0 | 0 | 1 | 1 |
| 1 1 0 1 | 1 | 1 | 1 | 1 | 1 | 1 | 1 | 1 | 1 | 1 | 1 | 1 | 1 | 0 | 1 | 1 | 1 | 1 | 0 | 0 | 1 | 1 |
| 1 1 1 0 | 1 | 1 | 1 | 1 | 1 | 1 | 1 | 1 | 1 | 1 | 1 | 1 | 1 | 1 | 0 | 1 | 1 | 1 | 1 | 0 | 1 | 1 |
| 1 1 1 1 | 1 | 1 | 1 | 1 | 1 | 1 | 1 | 1 | 1 | 1 | 1 | 1 | 1 | 1 | 1 | 0 | 1 | 1 | 1 | 1 | 1 | 1 |

ELECTRONIC BACKGAMMON

FIELD OF THE INVENTION

This invention relates to a system for displaying movement and the positions of game pieces on a game board and, more particularly, to an electronic system for selecting, moving and displaying game pieces for the game of backgammon.

BACKGROUND OF THE INVENTION

Backgammon is a game which has been played for many years and is still being played by millions of persons throughout the world. Despite the popularity of the game, the apparatus used for playing backgammon has remained substantially the same since it was invented. While such apparatus and the rules of backgammon are well-known, it will be helpful to describe them briefly for a better understanding of the present invention.

Backgammon is played with pieces on a board having 24 positions. The game is played by two players who manually move game pieces or men a number of positions on the board as determined by the throw of dice. Each player has fifteen men which are arranged on several positions about the board at the beginning of the game. The opposing players move their men in opposite directions on the board and it is the object of the game for each player to be the first to move all of his men into his "home" position to win the game, the "home" position being off the board. The "0" position of one player is the "home" position of the other player.

The position of the opposing men on the board determines the legality of a move. Each player builds up obstacles for his opponent by moving two or more men to the same position on the board. If a player has two or more men on one position, then this position is blocked and his opponent cannot move onto it, regardless of the dice throw. The rules also specify that if a player has one man on a position, then that one man is vulnerable. If the opponent moves his man to this position, he bumps that one man which then must be moved back to the 0 position.

SUMMARY OF THE INVENTION

It is an object of the present invention to provide novel apparatus for the game of backgammon.

It is another object of the present invention to provide an electronic backgammon game.

A further object of the present invention is to provide a game of backgammon in which there are no external game pieces that can be lost.

Another object of the invention is to provide a backgammon game in which manual movement is limited to switch controls exclusively, such as push buttons.

A still further object of the present invention is to provide built in error detection devices within the backgammon game to ensure fair play.

Another object of the present invention is to provide a game which can be played with minimum ambient light.

The foregoing and other objects of the present invention are obtained with a game console or board having a plurality of game positions and light emitting devices for each player A and B at each of the game positions. An electronic control system includes a memory which stores data that identifies the number of men of each player A and B on each of the game positions. Decoder/logic circuitry decodes this data and generates signals to energize a number of light emitting devices at each positiion in accordance with the stored information to display the location of each player's men.

The system also includes a main decoder cycle controller which is activated when a player makes a move to control movement of a man from one position, i.e., an initial position, to another position, i.e., a final position. If, for example, player A wants to move a man, and the move is legal, the cycle controller generates a first cycle of control signals to update the memory by removing a man from the memory position of player A corresponding to the initial position. The controller also generates a second cycle of control signals to update the memory by adding this one man of player A to the final position of player A. Then, if player B has one man on this final position, the memory is updated by removing player B's man from the final position and then, the cycle controller generates a third cycle of control signals to add this man to player B's 0 position.

The game board includes another group of light emitting devices, one for each player for each of the game positions. During this first cycle of the controller a counter counts pulses from a slow clock commencing with the initial position selected by player A. Each count is decoded by another decoder to energize sequentially a light emitting device in the other group for the player making a move, thereby displaying movement of the man from the initial position to the final position. The slow clock is stopped when the count in the counter corresponds to the final position.

A legal move detector circuit receives signals from the memory and decides if the move is illegal. At the start of the first cycle of the controller, the memory is addressed to read the number of men at the final position of player B to which player A desires to move a man and a comparator in the detector circuit determines if the read out signal is greater than 1. The detector circuit generates a stop signal if player B has 2 or more men on the final position, and prevents the cycle controller from cycling through to remove one of player A's men from the initial position.

The invention also includes electronic dice with each die having a plurality of light emitting devices which, when energized, indicate the number of positions a player may move a man. By pressing and then releasing a "spin" button, a random number of light emitting devices on each die will be energized. The invention further includes a points doubling system which includes a display of the multiplier of the number of points being played for and push buttons enabling each player to double the number displayed and hence the points being played for.

BRIEF DESCRIPTION OF THE DRAWINGS

FIG. 2 is a simplified block diagram of the circuitry of the present invention.

FIGS. 3A–3E are more detailed schematic diagrams of logic circuitry of the present invention.

FIG. 4 is a schematic diagram of logic for indicating when a player has taken a turn.

FIG. 5 is a schematic diagram of a doubler for doubling the points being played for.

FIGS. 6A and 6B are, respectively, schematic diagrams of light emitting diode arrays for displaying the men and the movement of a man from one position to another.

FIGS. 7A and 7B show truth tables for logic used in the present invention.

DETAILED DESCRIPTION OF THE DRAWINGS

Figure 1:
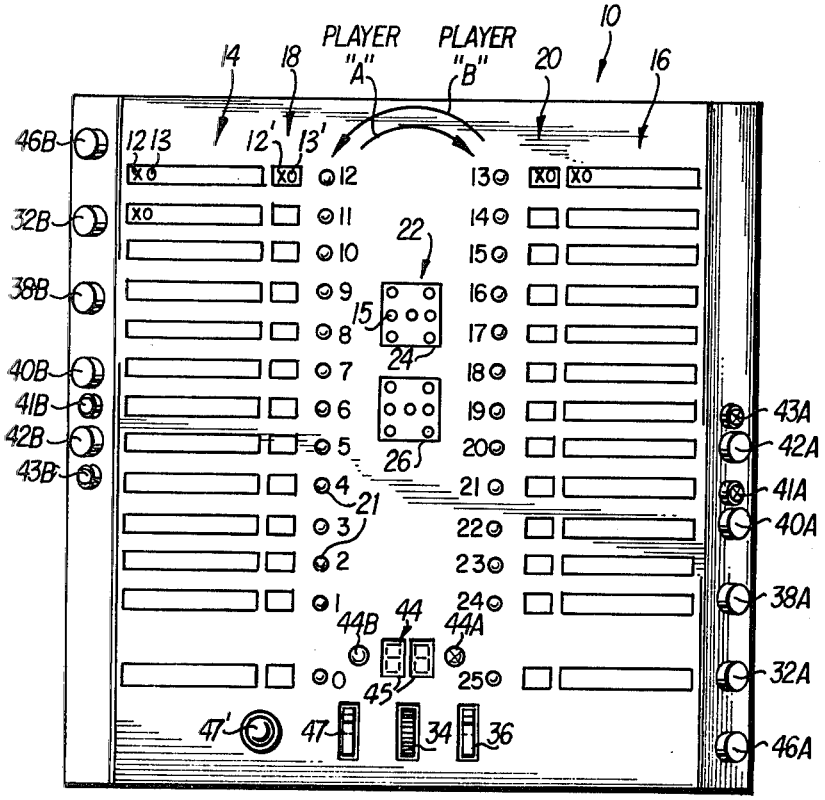
FIG. 1 is a top view of a game playing console according to the present invention.

FIG. 1 illustrates the mechanical layout of a game playing console according to the present invention. The console 10 includes 26 rows numbered 0–25 of light emitting diodes 12, 13 for the 26 game positions used in the present invention. The light emitting diodes are located in two columns 14, 16 which display the positions of the men. Each row includes six red light emitting diodes 12 for player A and six green light emitting diodes 13 for the other player B. Next to columns 14, 16 are two additional columns 18, 20, respectively, of light-emitting diodes 12', 13' for showing the movement of the men from one position to another position. Each of the columns 18, 20 includes two light emitting diodes, there being a red diode 12' for player A and a green diode 13' for player B.

For each position 0–25 there is a corresponding button 21 located near each of the rows of light emitting diodes 12, 13 to enable a player to select a position, i.e., an initial position, from which to move a man or in which to load a man at the beginning of the game.

As indicated by the arrows on the console 10, player A moves his men in a clockwise or positive direction while player B moves his men in a counterclockwise or negative direction about the console. Position number 0 is the 0 position of player A and the home position of player B, and position number 25 is the 0 position of player B and the home position of player A.

A pair of dice 22 including die 24 and die 26 are located in the center of the console 10 between columns 14, 18 and 16, 20. Each die includes seven light emitting diodes 15, the number of diodes being lit on a "throw" of the dice indicating the number of positions a player may move his men in accordance with the rules of the game.

At the start of the game, it is necessary for each player initially to place his men at various positions 1–24. Therefore, console 10 includes load new game buttons 32A, 32B for players A, B, respectively, a single hexadecimal thumbwheel binary coded switch 34 known in the art, and a single normally closed load new game switch 36. Each player uses 15 men and to load them initially at the various positions, player A, for example, opens normally closed switch 36 and presses on load new game button 32A. Player A then dials thumbwheel switch 34 to enter and store a signal corresponding to a desired number of men for a desired position. Then, this desired position is selected by depressing one of the position buttons 21 and, thereby, a number of red diodes 12 for player A in the selected position are energized in accordance with the dialed number. After player A has loaded his men in their initial positions on the console, player B in a like manner initially positions his men which will be indicated by the energized diodes 13 by opening switch 36, pressing button 32B and dialing thumbwheel switch 34.

A maximum of 15 men may be placed at any one position even though there are only 6 diodes for each player at a position. For example, by means of a predetermined code given in a logic truth table described below, if reading left to right in a row only the first two diodes of one player are lit, this may correspond to 2 men; however, if only the first and sixth lights are energized this may correspond to 7 men. Thus, though only two diodes in each instance are lit, different numbers of men are represented.

Console 10 also includes push buttons 38A, 38B for players A, B, respectively, for "spinning" the dice 22. Player A, for example, will "spin" the dice by depressing button 38A to activate electronic circuitry which energizes sequentially various numbers of light emitting diodes 15. When the button 38A is released, a number of diodes 15 on each die 24, 26 will remain lit until the next "spin". Due to the fast speed by which the electronics sequentially energizes various numbers of diodes 15, the player spinning the dice has no control over the number of diodes 15 which are lit after the button 38A is released, thereby making this number random. That is, button 38A is relatively so slow in deactivating the dice electronics after its release, that the electronics will have advanced through many cycles before deactivation. Player B can "spin" the dice in the same manner as player A by depressing and releasing his push button 38B.

The rules of backgammon specify that the number of positions a player can move his men is determined by each die separately. A player may move one man a number of positions indicated by each die 24, 26, or one man a number of positions indicated by one die and another man a number of positions indicated by the other die. Therefore, player A has two die select buttons 40A, 42A for dice 24, 26, respectively, and player B has two die select buttons 40B, 42B for dice 24, 26, respectively. If, for example, player A wants to move a man a number of positions as indicated by die 24 from position number 6, the move is executed by depressing button 40A and depressing button 21 associated with this position.

Each of the die select buttons has a light emitting diode 41A, 43A, 41B, 43B, respectively, to indicate when a particular die has been selected. When player A spins the dice by depressing button 38A, all diodes 41A, 43A, 41B, 43B are energized. Then, when die select button 40A is depressed, diode 41A is deenergized to show the selection of one die and when button 42A is depressed, diode 43A is deenergized to show the selection of the other die. When player A's turn is completed both diodes 41A, 43A are energized in anticipation of his next turn. A similar operation occurs with respect to diodes 41B, 43B, 41A, 43A, when buttons 38A, 40B and 42B are pressed.

Each game may be played for points initially determined at the beginning of the game and the multiplier of the number of initial points is indicated on a numerical display 44 shown on console 10. Display 44 is composed of two groups of light emitting diodes 45, arranged in a well known seven-segment display, to display the units and tens positions of the multiplier of the number of points being played for. During the course of the game, a player may feel that he is in a winning position and therefore may want to double the number of points. Console 10, therefore, has doubler buttons 46A, 46B for players A, B, respectively. By depressing button 46A, for example, player A will double the number shown on display 44 to double the number of points. Should player B feel he is in a winning position he too may double the number of points by depressing his doubler button 46B to double the number shown by display 44.

Two light emitting diodes 44A, 44B located on opposite sides of display 44 are energized, respectively, to indicate the last player who has doubled by depressing buttons 46A, 46B. If one of diodes 44A, 44B is energized, the other is deenergized. In accordance with the rules of the game, after a player has doubled, only the opponent may double next; however, this rule is not incorporated in the present logic circuitry, i.e., one player could depress his doubler button twice in succession and the display would react.

Also shown on console 10 is a common automatic load new game toggle switch 47. In an alternative or in addition to loading initially the game with thumbwheel switch 34, there may be a memory which stores preset numbers of men at initial positions for all the men. By operating toggle switch 47, the memory is activated to read out these numbers of men and energize appropriate diodes in columns 14, 16. Console 10 also has an error light 47' which is energized whenever an illegal or incorrect move is attempted.

As will be apparent from the discussion below, FIG. 2 is used to describe the features of the invention primarily functionally and operationally, as this will be most helpful in explaining and understanding the manner in which various moves may be made during the course of the game. FIGS. 3A–3E are used to describe in more detail the structural, functional and operational aspects of the present invention.

FIG. 2 is a simplified block diagram of the electronic control circuitry of the present invention. The push buttons 38A, 38B are coupled to electronic dice 48 having logic circuitry 49, 50 which controls each die 24, 26. A die selector 51 is connected to circuitry 49, 50 over lines 52, 54, respectively, to select individually a signal generated by the circuitry 49, 50 and corresponding to the number of positions a player may move as indicated by a respective die 24, 26. The signal selected by die selector 51 is fed over line 56 as one input to adder/subtracter 58. A position encoder 60 is connected to each push button 21 on console 10 and provides a signal, corresponding to the position (initial) from which a player wants to move a man, over line 62 as the other input to adder/subtracter 58.

Adder/subtracter 58 either adds or subtracts its two input signals, depending on whether player A or player B is taking his turn, and provides a resultant output signal over line 64 which is latched and stored in register 66. The resultant signal, therefore, defines the position (final) to which a player wants to move a man and is fed over line 68 as one input to a comparator 70. For example, if player A selects a die with 4 diodes lit and an initial position numbered 15, the final position will be $15+4=19$; if player B makes these selections his final position will be $15-4=11$ because of the direction in which his men move.

Position encoder 60 also feeds its output signal on line 62 to an up-down counter 72 which is thereby loaded with an initial count defining the initial position. Up/-down counter 72 is coupled over line 74 to slow clock 76 to count clock pulses up or down from the initial count depending on whether player A or B is moving a man. The output of up/down counter 72 is fed as the second input to comparator 70 over line 78 as well as to another counter 80 and a decoder 82. A fast clock counter 84 counts pulses from a fast clock 85 and its count is received over line 86 by counter 80 whose output is sent over line 88 to another decoder 90. Decoder 82 is coupled to the columns 18, 20 of light emitting diodes 12', 13' over 26 output lines 92 for each of the 26 game positions. Decoder 90 is coupled to the columns 14, 16 of light emitting diodes 12, 13 over 26 lines 94 for each of the 26 game positions.

A multiplexer 96 selects either the output signal of adder/subtracter 58 from line 64 or of the counter 80 from line 88 and couples this signal as an address to a memory 98 over line 100. Memory 98 stores information corresponding to the number of light emitting diodes 12, 13 which are to be lit for each of the 26 game positions and, hence, information defining the position of all the men used by players A and B. Memory 98 provides its output over line 102 to a legal move detector 104, a memory update counter 106 and decoder/-logic 108. Legal move detector 104, among other functions to be described, informs the player if the particular move he wants to make is legal in accordance with the rules of the game. Decoder/logic 108 provides a signal over line 110 to activate a number of light emitting diodes 12, 13 based on the addressed position. Memory update counter 106 updates the information concerning the number of men in the addressed position by adding one or subtracting one from that position. The updated addressed position is then written into the memory 98 through a multiplexer 112 which selects either the output of counter 106 or a signal over line 107 from the thumbwheel switch 34 depending on the state, open or closed, of switch 36.

When a player presses one of the position push buttons 21, and one of the load new game buttons 32A, 32B or die select buttons 40A, 42A, 40B, 42B, signals are generated to activate a player control signal generator 114 which generates control signals for controlling various of the above-described elements to function in a particular way depending on which player A or B is moving a man. If a load new game or a die select button is pressed, control signals A, A', A'' for player A or signals B, B', B'' for player B are generated, and when one button 21 is pushed on, an execute signal E is generated. With certain exceptions which will be described, when player A depresses one of buttons 32A, 40A, 42A, signal $A=A'=A''=0$ and signal $B=B'=B''=1$. When player B depresses one of buttons 32B, 40B, 42B, signal $B=B'=B''=0$ and $A=A'=A''=1$.

A main decoder cycle controller 116 generates control signals R, S, T, U, V, W, X, Y and may be activated from 1 to 3 times for each move, depending on the legality of the move, to process data for moving a man. Cycle controller 116 is activated a first time when a player presses one of the buttons 21 by receiving the execute signal E to generate one or more of the control signals R–Y. Cycle controller 116 may be activated a second time by an output signal C of comparator 70 over line 118 to generate one or more of the control signals R–Y. Cycle controller 116 may be activated a third time by a clear signal F from legal move detector 104 to generate one or more control signals R–Y. Control signal Y, in addition to other functions to be described, is fed back over line 120 to prevent main decoder cycle controller 116 from being activated a second or third time until signal C or F is generated.

Also disclosed in FIG. 2 is a doubler 122 which is activated whenever one of the players A or B presses his respective doubler buttons 46A, 46B to double the number of points being played for. Doubler 122 includes logic circuitry which provides output signals to energize display 44.

The operation of the apparatus of FIG. 2 is as follows. Assume that players A and B have initially loaded their men into various of the 26 positions stored in memory 98. Player A then "spins" the dice 22 by depressing and then releasing button 38A. As a result, each die 24, 26 will have lit a random number of diodes 15 constituting the throw of the dice. Player A then selects one die 24, 26 by depressing, for example, die select button 40A to move one of his men a number of positions indicated by the selected die. Die selector 51 then couples a signal corresponding to the number of diodes 15 lit on the selected die to one input of adder/subtracter 58. Then, player A selects the position (initial) from which he wants to move one of his men the number of positions indicated by the selected die by depressing one of the buttons 21. The selected position is encoded by position encoder 60 which feeds a signal to the other input of adder/subtracter 58 and to up/down counter 72, thereby loading counter 72 with a count corresponding to the selected initial position. Adder/subtracter 58 adds the two input signals and signal E loads register 66 with a signal identifying the final position of the selected man. For example, if player A selects position 2 and the selected die has 5 diodes lit, then the final position will be 2+5 or position number 7.

In accordance with the rules of the game, if the final position to which player A wants to move his selected man has two or more of player B's men on that position, the move is illegal and cannot be made. Therefore, before the move by player A is made, the final position is interrogated to see if player A can move his selected man. When player A presses one of the position buttons 21, the execute signal E is generated to activate main decoder cycle controller a first time. First signal S is generated to enable multiplexer 96 to select the output of adder/subtracter 58, which addresses the final position in memory 98, and to enable memory 98 to output the number of men of player B in this final position. Then, signal R is generated to activate legal move detector 104 which compares the signal corresponding to the number of men of player B at the final position with the number 1 to see if it is greater than 1. For this move by player A, it is assumed that player B has no men on the final position; therefore the move is legal and allowed to continue.

Since the move is legal and player A will move one man off his initial position it is necessary to update the memory 98 for this position. This is accomplished when, after generating signal R, cycle controller 116 generates signal T to load counter 80 with the initial position loaded in counter 72. With signal S now not generated, multiplexer 96 selects the initial position from counter 80 and addresses memory 98 with it. Cycle controller 116 next generates signal U to load memory update counter 106 with the number of men of player A in the addressed initial position of memory 98. Then, signal V is generated to enable counter 106 to subtract 1 from the number of men in this initial position, the counter 106 being in the subtract state since signal C is not generated by comparator 70 at this time. Next, cycle controller 116 generates signal W to write, via signal H generated in detector 104 and responsive to W, the updated number of men in the initial position of player A into the memory 98 through multiplexer 112 which selects the output of counter 106 because switch 36 is closed. Cycle controller 116 then generates signal X to clear memory update counter 106, and then generates signal Y to enable fast clock counter 84 to count pulses from fast clock 85 and prevent controller 116 from cycling through again.

When fast clock counter 84 is activated, the arrays 14, 16 will be energized to display the various positions of player A's and B's men. Counter 80 starts counting the clock pulses from fast clock counter 84. With each pulse the count in counter 80 is increased by 1 and thus a new position in memory 98 is addressed with each pulse. Also, decoder 90 simultaneously decodes each new position represented by the count in counter 80. Each of the 26 rows of diodes 12, 13 is sequentially activated by the outputs of decoder 90 and simultaneously with the activation of each row, decoder/logic 108 energizes a number of diodes in the row as determined by the signal outputs of memory 98. Fast clock counter 84 produces pulses at such a fast rate that to the players it appears the array 14, 16 is continuously lit. Counter 84, which divides the output of clock 85, gives the option of changing the counter 80 data rate and, hence, the memory 98 data rate by providing a counter 84 with a predetermined division ratio.

After decoder 90 decodes position number 26 for one player, counter 80 is reset to 0 by the output on line 25 of the decoder 90 to commence counting the 26 positions for the other player. Thus 52 addresses are needed, 0–25 for player A and then 0–25 for player B, to display the men. For the first 26 addresses 0–25, signal A″ is generated to enable memory 98 to read out the 26 positions of player A and to provide a common control for diodes 12; for the second 26 addresses 0–25, signal B″ is generated to enable memory 98 to read out the 26 positions of player B and to provide a common control for diodes 13.

Two additional steps are performed before this legal move of player A is completed in which player B has no men on the final position. First, player A's man must be moved to the final position, during which time there is provided a display of the actual movement of the selected man. Second, the memory 98 again must be updated to store information that player A has moved a man into the final position.

To display movement of the man selected by player A, when counter 106 subtracts 1 from the initial position during the first cycle of controller 116, signal V also enables counter 72 to count pulses from slow clock 76. Up/down counter 72 now starts to count up (since player A is moving a man) the pulses from slow clock 76 and the count in counter 72 is decoded by decoder 82. Counter 72, which is loaded with the initial position, and decoder 82, together with control signal A common to all diodes 12′ activate the row in column 18 or 20 associated with the initial position of diode 12′, thus visually indicating the man player A will move. Then, as counter 72 counts the slow clock pulses, decoder 82 sequentially decodes the positions, and as each position is decoded a corresponding diode 12′ for player A in column 18 or 20 is lit to show movement of the selected man until the final position is reached. Clock 76 is relatively slow compared to the output of clock counter 84 so that the players can see diodes 12′ energized and de-energized in columns 18, 20 as the selected man is moved while array 14, 16 is lit.

The final position is undated with player A's man in the following manner. As already indicated, one input to comparator 70 is the final position loaded into register 66, and the other input is the output of counter 72. When counter 72 reaches a count corresponding to the final position an equality comparison is made and output signal C is provided over line 118 to activate cycle controller 116 for another cycle, except that this signal prevents the generation of signals R and S to prevent legal move detector 104 from performing its legal move detecting function. Signal C also prevents counter 72 from counting the slow clock pulses. Controller 116 then generates signal T to load counter 80 with the count in counter 72, which at this time corresponds to the final position of the move made by player A. Memory 98 is then addressed with the final position for player A and the number of player A's men in this final position is loaded into undate counter 106 when controller 116 next generates signal U. Controller 116 next provides signal V and this time, since one man of player A is to be added to a position, rather than subtracted from a position, counter 106 adds a logic 1 to the count under the control of signal C from comparator 70. Then, cycle controller 116 generates a signal W to write via the signal H generated in detector 104 the updated number of men in the final position into memory 98 through multiplexer 112. Signal X is then generated to clear counter 106 and then signal Y is generated to start again the fast clock counter 84 and prevent another cycle of controller 116.

The above discussion assumed that player A's move was legal and that player B has no men in the final position. However, in accordance with the rules of the game, the move still may be legal if player B has only one man on the final position. In this case, it is not only necessary to update the number of men in the final position for player A, as described above, but also to update the number of player B's men in this final position since this man of player B is "bumped" and returned to his "0" position. Under this condition where player B has one man in the final position the cycle controller 116 will be enabled to go through a third cycle.

To update the final position of player B when he has 1 man on it, when loaded initially with the output of memory 98 during the first cycle of controller 116, legal move detector 104 not only compares the number of men in the final position of player B to see if it is greater than 1, it also compares this number to see if it is equal to 1. During the second cycle with signal C being generated, when control signal X is generated these two signals activate detector 104 to generate a strobe signal which enables detector 104 to output a signal if an equal comparison is made. If the number of men of player B in the final position = 1, the write signal H is generated for memory 98. Prior to generating this write signal H, counter 106 was cleared with signal X; and, as will be described, memory 98, which is addressed with the final position, is addressed with this memory position for player B. Consequently, a zero is written into memory 98 for player B via multiplexer 112, thereby bumping player B's man.

With player B's man bumped, it is now necessary to position this man in player B's "0" position and this is the reason for the third cycle of cycle controller 116. After a short delay, legal move detector 104 generates signal F to enable cycle controller 116 for a third time and to clear counter 80. In this third cycle signals R and S will not be generated to utilize detector 104's legal move detecting function since signal C is generated. Also, with signals C and X being generated, the control signal T is not generated to load counter 80 with the count in counter 72. At this time with counter 80 being cleared, the memory 98 address is 25 (as described below). Therefore, the number of men of player B in his "0" position (position number 25) is read out of memory 98 and loaded into counter 106 when controller 116 generates signal U. Since signal C is being generated by comparator 70, undate counter 106 is controlled to add 1 to the number of player B's men in this 0 position when controller 116 next generates signal V. This updated number of men is then written into memory 98 through multiplexer 112 when controller 116 next generates write memory signal W, and thereafter signals X and Y are generated to clear counter 106, start fast clock counter 84 and disable controller 116.

There now will be described the condition when player A has chosen to move his man to a final position having two or more of player B's men, this being an illegal move. During the first cycle of controller 116 when signals R and S are generated, detector 104 will detect this condition. This will cause detector 104 to energize error light 47' and generate a signal which is fed to the cycle controller 116 to prevent signals V and W from being generated. Thus, in this first cycle of controller 116 player A is not allowed to remove a man from his selected position because memory update counter 106 is not enabled to update the number of men in the selected position and memory 98 cannot write the output of counter 106. Controller 116, however, in this first cycle does cycle through to generate signal Y, thereby activating fast clock counter 84 and deactivating the controller 116. Only when player A presses another of the buttons 21 to make a legal move will controller 116 be energized for a first cycle to generate all signals R–Y.

Having selected one die and made a move which is legal, player A is now ready to select the other die and the position from which he wants to move a man a number of positions as determined by this other die. Player A, therefore, presses the other die select button to enable selector 51 to select the other die and then pushes one of the position buttons 21 to commence the move. The above-described operation of the circuitry of FIG. 2 in connection with the selection by player A of the one die is the same when the other die is selected.

After player A has completed his turn, player B then "spins" the dice by depressing and releasing button 38B to energize, randomly, a number of diodes on each die 24, 26. Player B then first selects one die by depressing one of the die selector buttons 40B, 42B. Again, as with player A, the move is commenced by depressing one of the position buttons 21 corresponding to the position from which player B wants to move one of his men.

The operation of the circuitry of FIG. 2 is the same for player B as it is for player A, except for several differences which will now be described. As shown in FIG. 1, player A moves his men in a clockwise direction illustrated by the arrow, and this may be considered a positive direction. Thus, when die selector 51 provides a signal to the adder/subtractor 58, this signal is added to the signal from the position encoder 60. Player B, however, moves his men in the counterclockwise direction illustrated by the other arrow and this may be considered a negative direction. Therefore, the signal provided by die selector 51 to adder/subtractor 58 must be subtracted from the signal provided by position encoder 60; for example, if player B selects position 23 and the selected die is 5, then player B wants to move his man to position 18 (23−5). Therefore, die selector 51 provides the complement of the signal corresponding to the selected die and this complemented signal is logically added in adder/subtractor 58, thereby providing a subtraction operation.

Another difference in operation depending on which player is moving relates to up/down counter 72. When player A depresses one of his die select buttons 40A, 42A, this provides control signal A to enable counter 72 to count up in accordance with the positive direction of movement of player A's men. However, when player B selects one of his die select buttons 40B, 42B, control signal B enables counter 72 to count down in accordance with the negative direction of movement by player B.

As described above, to determined whether a move by player A is legal the number of men of player B in the final position is read by memory 98 to detect how many men player B has on it. However, when it is player B's turn, the legality of his move is determined by enabling memory 98 to read the number of men of player A on the final position of player A to detect how many of the latter player's men are on it.

The manner in which the game board 10 is initially loaded at the start of the game will now be described. Player A may accomplish this by opening normally closed switch 36 which will prevent controller 116 from generating signals R, S to prevent legal move detector 104 from performing its legal move detection function and enable multiplexer 96 to select the output of counter 80, respectively. Player A then dials the thumbwheel switch 34 to generate a signal corresponding to a desired number of men he wants to place in a particular position. Then, player A presses his load new game button 32A to generate player signal controls A, A', A" and then selects that desired position by depressing a corresponding button 21 which thus activates controller 116. When switch 36 is opened multiplexer 112 is enabled to select the load new game data rather than the output of counter 106. Controller 116, being energized, provides signal T to load counter 80 with the selected initial position and, hence, memory 98 is addressed at this position. Then, signals U and V are generated, but multiplexer 112 will not select the updated position from counter 106. Next, signal W is provided to generate signal H to write memory 98 with the load new game data from multiplexer 112 and, finally, counters X and Y are generated to clear counter 106 and start fast clock counter 84. Cycle controller 116 only goes through one cycle since signal C is not generated to energize controller 116 again when initially loading the game. Player A may now select a number of men to place initially in another position by dialing thumbwheel switch 34 and depressing another of the buttons 21. Player B may load his men initially in the same manner as player A, except that he will depress his own load new game button 32B, to generate player signal controls B, B', B".

Figure 3A:
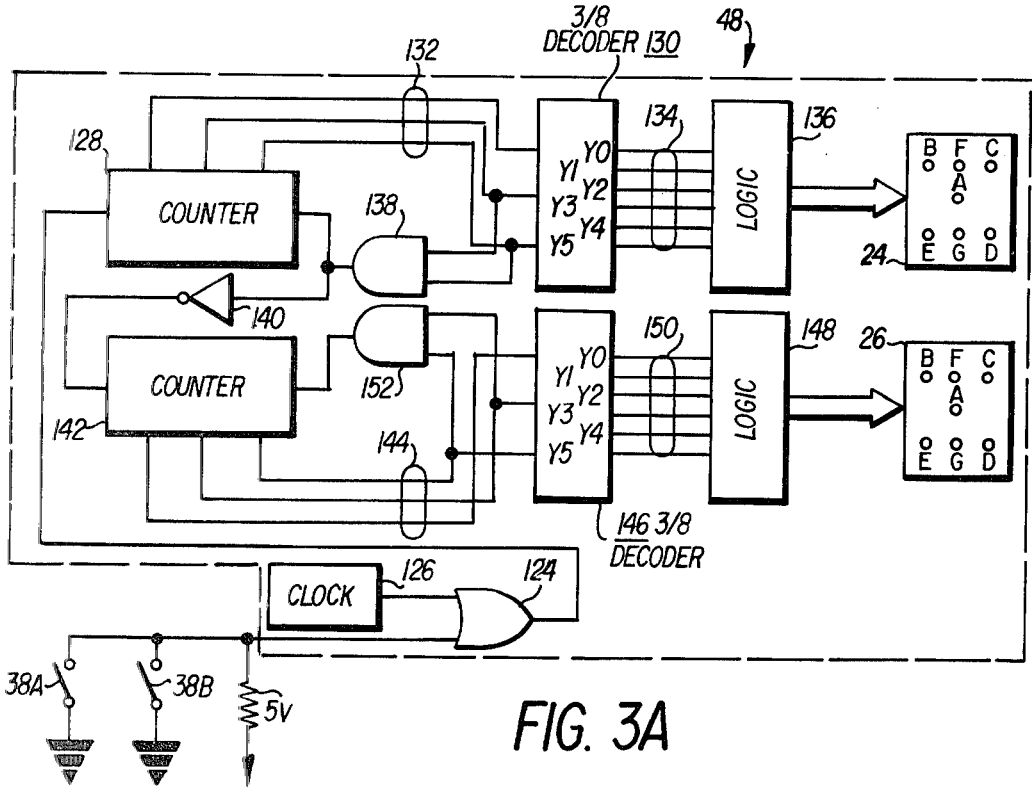

FIGS. 3A–3E show a more detailed schematic diagram of the present invention. In FIG. 3A, electronic dice 48 includes an OR gate 124 which receives as one input clock pulses from a fast clock 126 and 5 volts from another input, except when one of the players A or B presses a "spin" button 38A, 38B connected to ground. A counter 128, which can count from 0 to 5, counts the pulses from clock 126 when one of the buttons 38A, 38B is closed and provides its count to a $\frac{3}{8}$ decoder 130 over three output lines 132. Decoder 130 decodes the count of counter 128 and provides a signal over 6 lines 134 to logic 136 which energizes a number of diodes on die 24 in accordance with the count in counter 128. An AND gate 138 is coupled to two of the output lines 132 and provides an output signal for clearing counter 128 when a count of 6 is reached.

The clear signal from gate 138 is also fed through an inverter 140 to another counter 142 which counts the clear pulses of gate 138, the counter 142 also counting from 0 to 5. The count stored in counter 142 is fed over 3 lines 144 to a $\frac{3}{8}$ decoder 146 which decodes the count and provides a signal to logic 148 over 6 lines 150. Logic 148 is coupled to die 26 and energizes a number of its diodes in accordance with the count of counter 142. An AND gate 152 is connected at its input to two of the lines 144 to provide a clear signal at its output to counter 142 when the counter has reached a count of 6.

To "spin" the dice, player A, for example, closes button 38A connecting the 5 volt input of gate 124 to ground, thereby gating very fast clock pulses from clock 126 to counter 128. When a count of 6 is counted, there are two inputs to gate 138 which result in a clear signal to clear counter 128 to count from 0 to 5 again. As decoder 130 follows and decodes the rapidly changing count in counter 128, logic 136 interprets this and rapidly changes the number of diodes 15 energized on die 24 in accordance with the count. Each time gate 138 generates a clear signal this is inverted by inverter 140 and counted by counter 142. In the same manner as with counter 128, decoder 146 and logic 148 decode and interpret the count in counter 142 to change quickly the number of diodes lit on die 26. AND gate 152 receives two inputs when counter 142 has counted 6 pulses to reset this counter. When play A releases button 38A, no more clock pulses are gated, and die 24 and die 26 display a number of diodes corresponding to the count in counters 128, 142.

Figures 5, 7A:
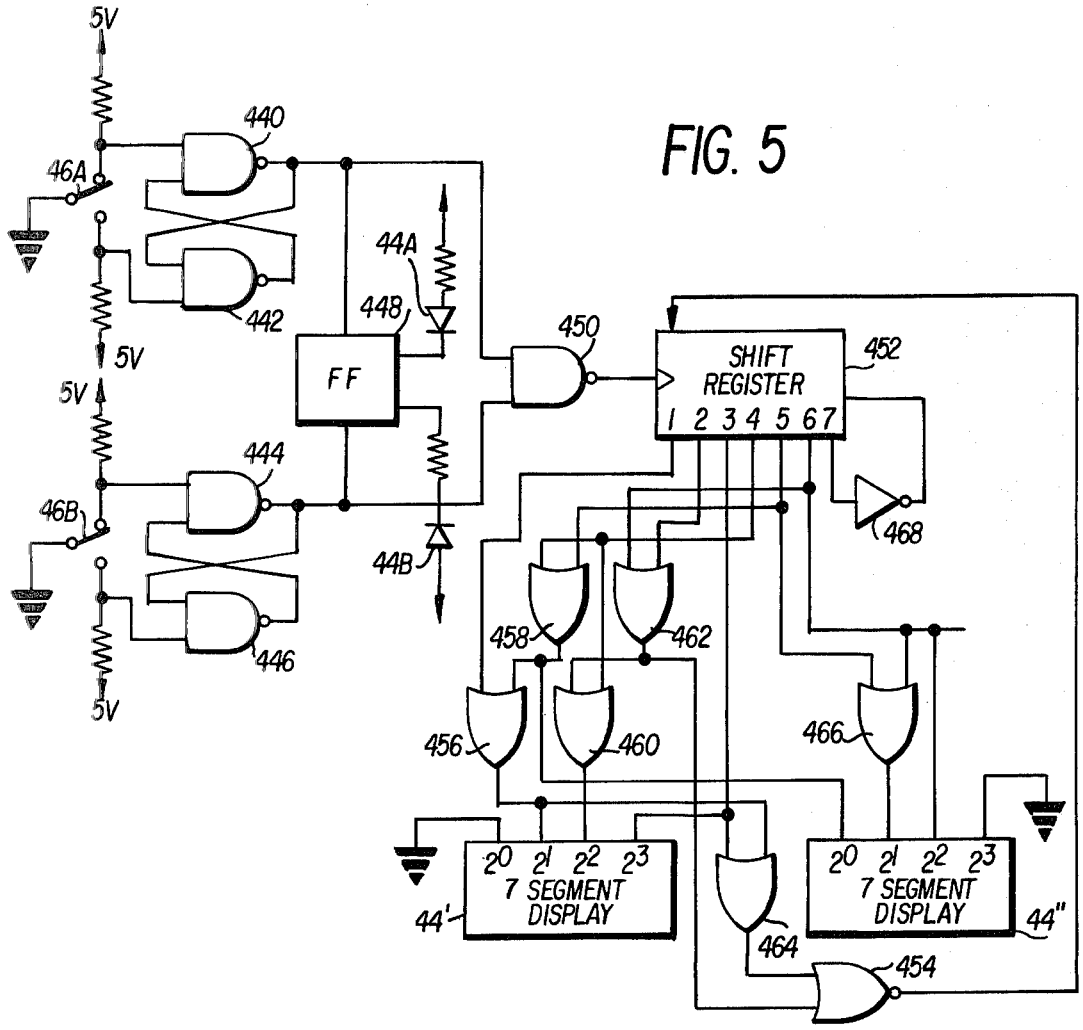

FIG. 7A shows the truth table I for both logic 136, 148. With a binary input to decoders 130, 146 given in the left hand column, these decoders provide binary outputs over output lines $Y_0$–$Y_5$ comprising lines 134, 150 as given in the center column. Logic 136, 148 interpret these outputs to energize the dice diodes A–G as shown in the right hand column and FIG. 3A.

With reference to FIG. 3B, die selector 51 includes a multiplexer 152 which selects the output signal on lines 132 or 144 of counters 128, 142, respectively. The selection of counters 128 or 142 is made via a signal on line 153 from a flip-flop 154 which is connected to the outputs of two AND gates 156, 158 at its preset and clear terminals, respectively. AND gate 156 has its two inputs coupled to die select buttons 40A, 40B while AND gate 158 has its two inputs coupled to die select buttons 42A, 42B. The output of multiplexer 152 is coupled to an adder 160 which adds a logic 1 to this output and feeds it directly to a multiplexer 162 or through three inverters 164 to multiplexer 163. Multiplexer 162 has a select input connected to buttons 40A, 42A to select either the output of adder 160 or the complementary output from inverters 164. The output of multiplexer 162 is fed over four lines 166 to adder/subtractor 58.

Die selector 51 operates in the following manner. If, for example, player A wants to select die 24, he depresses button 40A which causes the output of AND gate 156 to go low momentarily, thereby providing a select signal at the output of flip-flop 154 which causes multiplexer 152 to select the signal on lines 132. If player A wants to select die 26, he depresses button 42A which causes the output of AND gate 169 to go low momentarily, and this clears flip-flop 154 thereby causing multiplexer 152 to select a signal on lines 144.

Adder 160 adds the logic "1" to the output of multiplexer 152; the reason for this is that the outputs of counters 128, 142 are 1 less than the die spin. For example, 000 from counters 128, 142 will represent snake eyes which is 1, 1; i.e., one diode on each diode 24, 26 will be lit. This is true for the remaining combinations because counters 128, 142 count 0–5 rather than 1–6. Therefore, 0001 must be added by adder 160 to represent the number of diodes lit on a die.

With button 40A or 42A pressed, player signal control A=0 and multiplexer 162 selects the direct output from adder 160 and feeds it to adder/subtractor 58. If player B is making a move, he pushes either button 40B or 42B to enable multiplexer 152 to select the output from counter 128 or 142. Since button 40B or 42B is pressed, player signal control A=1 and multiplexer 162 selects the complemented signal from inverters 164 and feeds this to the adder/subtractor 58. As mentioned above, the complemented signal is used for player B since his men move in the reverse or negative direction with respect to the movement of player A's men.

Figure 3C:
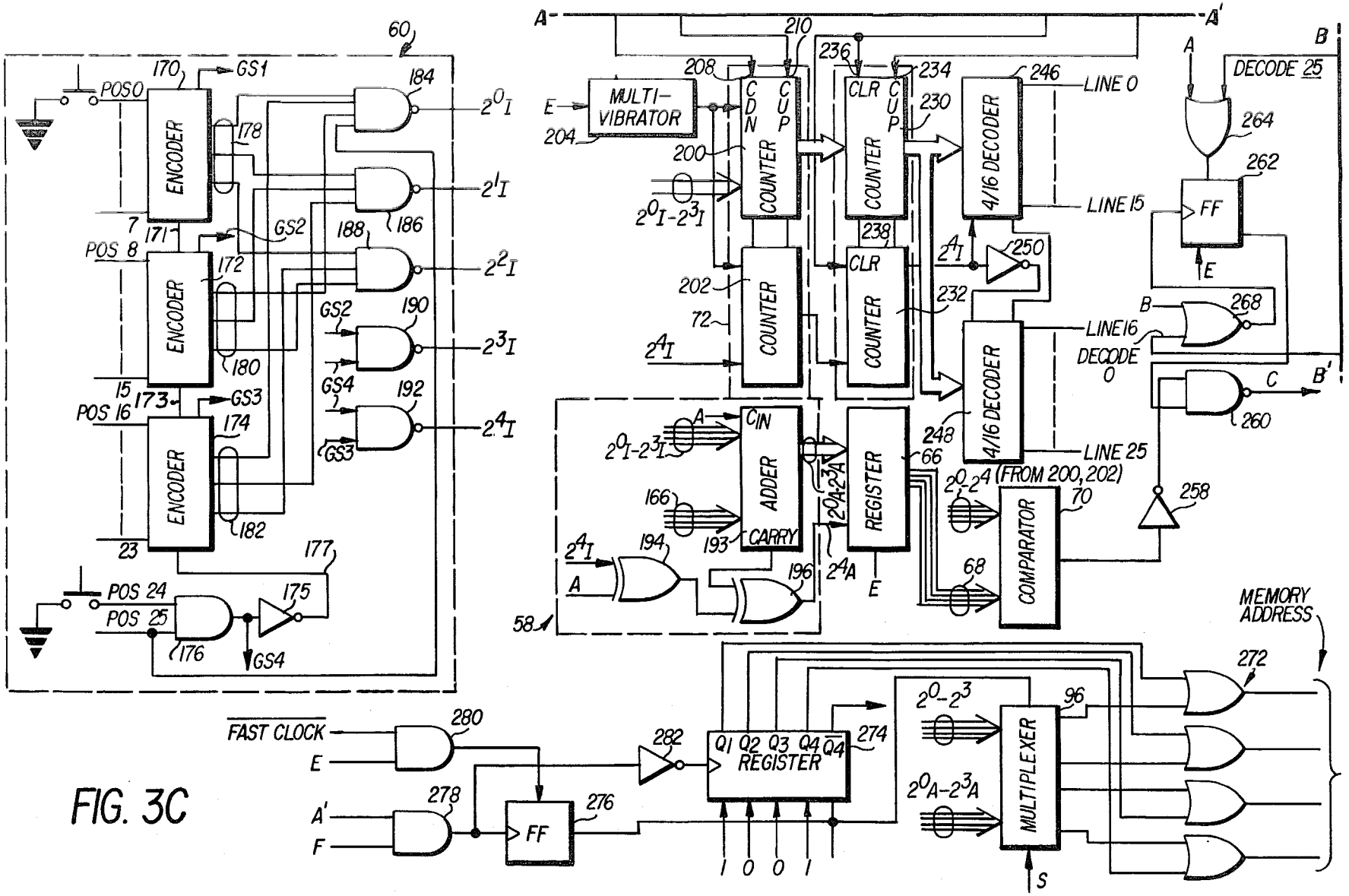

As shown in FIG. 3C, position encoder 60 includes three group encoders 170, 172, 174 which are connected to buttons 21 and encoder positions 0–7, 8–15, 16–23, respectively, and an AND gate 176 for selecting position 24 or 25 from corresponding buttons 21. Encoders 170, 172, 174 are coupled together over lines 171, 173 and encoder 174 is coupled to AND gate 176 via an inverter 175 over line 177. Each encoder 170, 172, 174 encodes one of eight positions and therefore has three output lines 178, 180, 182, respectively, coupled to NAND gates 184, 186, 188 as shown. The button 21 for position number 25 is also connected as an input to NAND gate 184. A NAND gate 190 has two inputs coupled to group signals GS2 and GS4, provided by the outputs of encoder 172 and AND gate 176. Another NAND gate 192 has two inputs receiving the group signal GS4 and another group signal GS3 from encoder 174. Encoder 170 also provides a group signal GS1 as an output signal. One of the group signals GS1–GS4 is generated when one of the buttons 21 is pressed to provide the execute signal E and indicates that a player has selected a position from which he would like to move one of his men. The outputs of NAND gates 184, 186, 188, 190 and 192 comprise a 5-bit binary word $2^0$–$2^4$I representing the initial position from which a player would like to move a man. Only an AND gate 176 is required for position numbers 24, 25 since there are only two positions that have to be encoded, rather than, for example, the eight positions 16–23 which are encoded by encoder 174.

Each of the NAND gates 184, 186, 188, 190, 192 must have a low input to provide an output bit. Also, the encoders 170, 172, 174 and gate 176 are connected to each other to force high the outputs of the encoders in front of the activated encoder or gate 176. Thus, if position button number 24 is depressed, the output GS4 of gate 176 goes low and the output of inverter 175 is high forcing encoders 170, 172, 174 high. The low output GS4 is also fed to NAND gates 190, 192 thereby providing a high for the $2^3$I, $2^4$I bits only which corresponds to position 24. If position button number 16 is depressed, encoders 170, 172 are forced high and encoder 174 encodes this button number by generating low signal GS3 which is fed only to gate 192 thereby providing a high for the $2^4$I bit corresponding to number 16. If position button number 6 is depressed, encoder 170 provides low outputs to gates 186, 188 thereby making the $2^1$I and $2^2$I bits high corresponding to number 6. As may be readily determined, therefore, by depressing one of the position buttons numbered 0–25, the $2^0$I–$2^4$I bits will be generated to represent a selected position.

The 5-bit code word from encoder 60 is fed to adder/subtractor 58 which provides a binary output $2^0$A–$2^4$A and comprises an adder 193 which receives as one input the $2^0$I–$2^3$I bits from encoder 60. The $2^4$I bit from encoder 60 is fed as one input to exclusive OR gate 194 having another input receiving control signal A. The output of gate 194 is fed to another exclusive OR gate 196 whose other input is the carry bit from adder 193. The other input to adder 193 is the 4-bit word from multiplexer 162 over line 166.

Adder 193 is a 4-bit adder whose maximum output equals 15; yet 5-bit words are needed from encoder 60 to define the 26 positions 0–25. Therefore, the exclusive OR gates 194, 196 are required together with the carry bit from adder 193 to perform the addition. The carry bit indicates whether the sum of the two 4-bit input signals to adder 193 is greater than 16. For example, if these two 4-bit inputs represent 13+5=18, the output $2^0$A–$2^3$A of adder 193 is a signal representing 2 and the carry bit, which is a logic 1, represents 16.

If, for example, player A is moving, control signal A=0 and the $2^4$A bit from gate 196 equals the carry bit +$2^4$I, since an exclusive OR gate takes 2 inputs, adds them and disregards any carry. If player B is moving, then control signal B=0 and signal A=1. Furthermore, when adder 193 has to logically subtract, i.e., player B is moving, as would be known an additional +1 must be provided in adder 193 to perform the subtraction properly. Therefore, adder 193 has a $C_{in}$ input in which if player A is moving, signal A=0 and adder 193 adds normally, while if player B is moving, signal A=1 and the additional +1 is added.

Adder 193 adds the $2^0$I–$2^3$I bits from position encoder 60 and the 4 bits from multiplexer 162 and provides the 4-bit output $2^0$A–$2^3$A while gate 196 provides the 1 bit output $2^4$A, these 5 bits being fed as the input to register 66 over line 64. When one of the group signals GS1–GS4 is generated, register 66 receives the execute signal E to latch the input data in the register, thereby storing the final position to which a player wants to move a man.

The 5 bits stored in register 66 are fed over 5 lines corresponding to line 68 as one input to comparator 70. The other input to comparator 70 is a 5-bit output from counter 72 which comprises a first counter 200 that stores the $2^0$I–$2^3$I bits from encoder 60 and a second counter 202 which stores the $2^4$I bit from the encoder 60. The 5 bits are loaded into counters 200, 202 after a short delay provided by a one shot multivibrator 204 which is activated in response to the execute signal E to give time for the input data to be stable before loading. Counter 200 has a count down input 208 and a count up input 210 to count slow clock pulses from the slow clock 74.

Figure 3D:
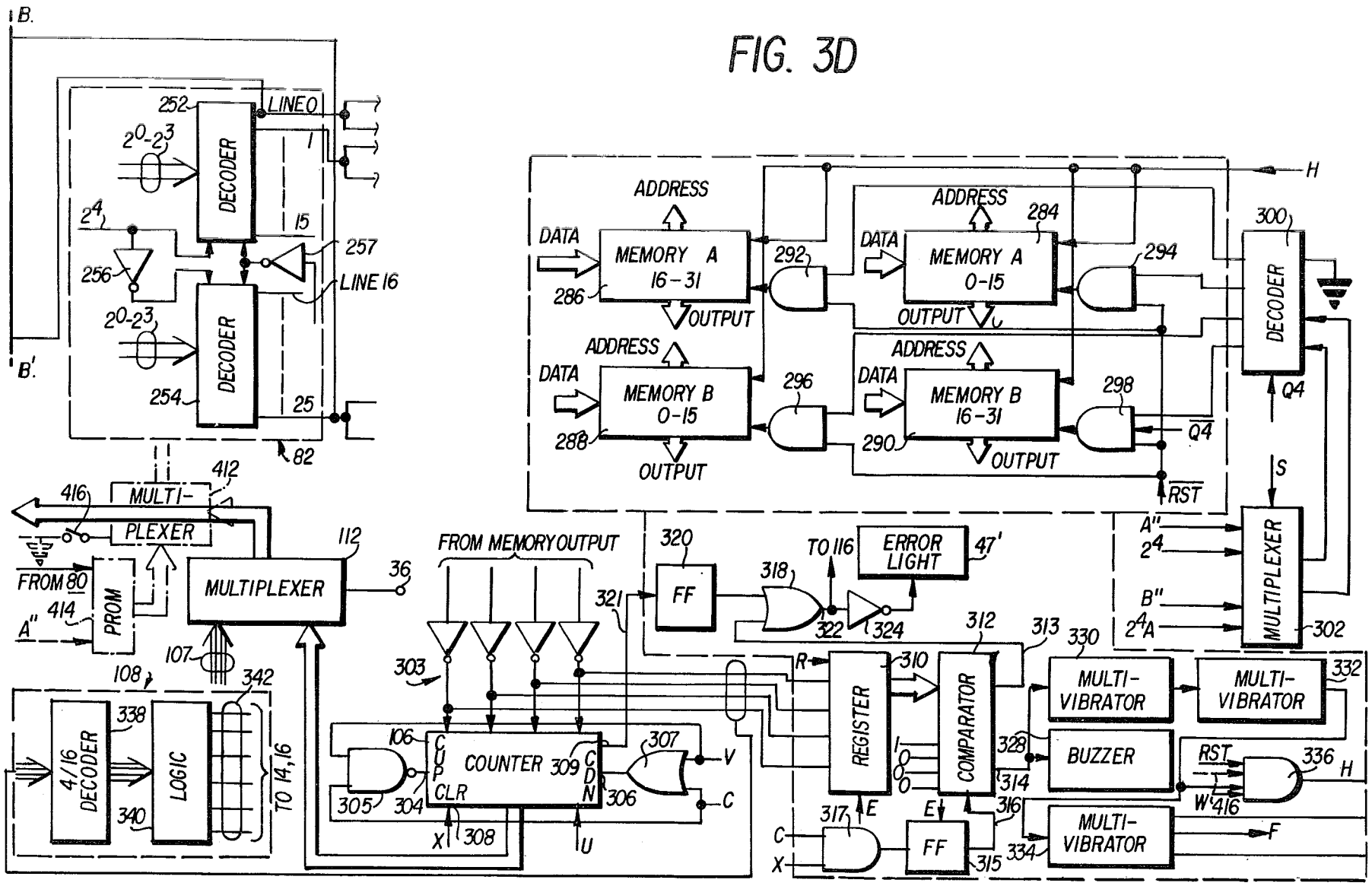
Figure 3E:
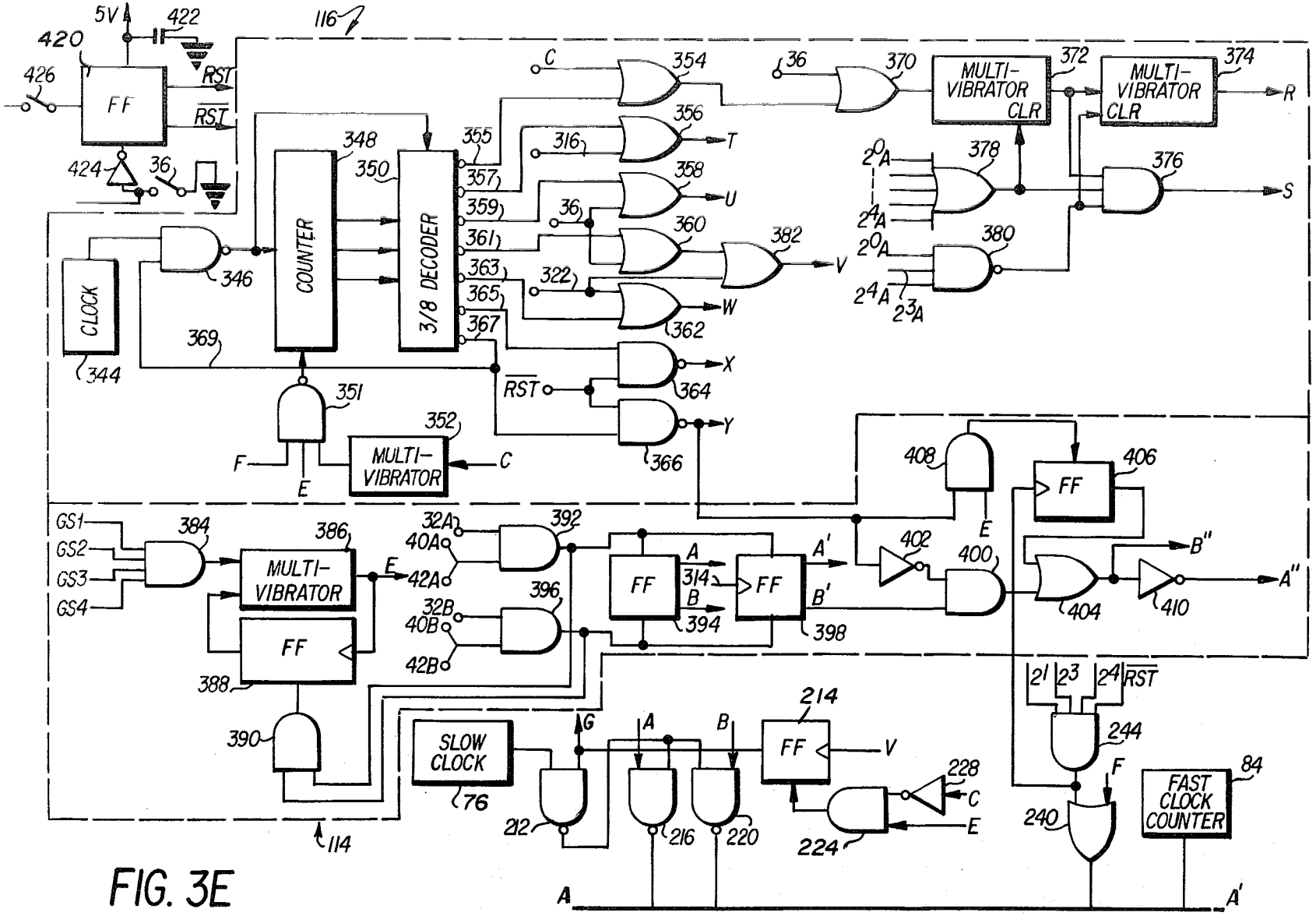

As shown in FIG. 3E, the clock pulses from clock 76 are fed as one input to a NAND gate 212 whose other input is connected to the output of flip-flop 214. The output of NAND gate 212 is fed as one input to NAND gate 216 whose other input is the signal A indicating that player A is moving his men. The output of NAND gate 212 is also fed to a NAND gate 220 whose other input is signal B indicating that player B is moving his men. The output of gate 216 is coupled to the count down input 208 while the output of gate 220 is coupled to the count up input 210.

Flip-flop 214 has a clear input connected to the output of an AND gate 224 which receives the execute signal E as one input and an inverted signal of the output signal C of comparator 70 via an inverter 228. Flip-flop 214 receives signal V as clock input to enable counters 200, 202 to count pulses from clock 76. The output of flip-flop 214 is also used as a slow clock control signal G.

When, for example, player A depresses a position button 21, the signal E is generated to enable gate 224 to clear flip-flop 214 so its output is initially low, keeping the output of gate 212 high; therefore, no clock pulses are passed to counter 200. Signal E also activates controller 116 which, assuming the move is legal, will provide signal V in its first cycle. Flip-flop 214, upon receiving V, has its output clocked high allowing inverted slow clock pulses to pass through gate 212. Since player A is moving a man he will have depressed one of his die select buttons 40A, 42A to generate signal A (which is 0, therefore signal B is 1), thereby enabling gate 220 to gate the slow clock pulses to the count up input of counter 200. As a result, counter 200, 202 slowly count pulses from the initial position stored in counter 72. When counters 200, 202 reach the final position of the move, signal C is generated and inverted by inverter 228 to enable gate 224 and force the flip-flop 214 output low, thus stopping the counting of pulses from clock 76. When player B is taking his turn and the move is legal, gates 212, 216 will be enabled to allow counters 200, 202 to count down from the initial position since at this time signal A is 1 and signal B is 0.

As shown in FIGS. 3C and 3E the 4-bit output of counter 200 and the 1-bit output of counter 202 are fed, respectively, to counters 230, 232, respectively, comprising counter 80. Counter 230 has a count up input 234 coupled to the fast clock counter 84. Counters 230 and 232 have clear inputs 236, 238 coupled to the output of an OR gate 240 which has two inputs for receiving, respectively, the clear counter 80 signal F and the output of an AND gate 244. AND gate 244 receives three bits as outputs from counters 230, 232, that is the $2^1$, $2^3$, $2^4$ bits which correspond to position number 26, and a reset $\overline{RST}$ clear signal which is generated as will be described below. When these three bits are received it is an indication that counter 80 should be reset to count again from 0–25 to enable arrays 14, 16 to be lit; thus, if $\overline{RST}=1$ at this time, gate 244 is enabled to provide an output to gate 240. Whenever a signal appears at either of the inputs to OR gate 240, the counters 230, 232 are cleared to commence counting from zero.

The $\overline{RST}$ signal is generated for the following reasons. Though there are only 26 game positions, memory 98 has capacity for 32 positions and is randomly distributed with data in all memory positions including position numbers 26–31. If, near the end of the game, player A, for example, has one man left on position number 23 and spins a 4, the final position number 27 will be interrogated to see if the move is legal. If there is more than 1 opposing player's man in this position represented by the random data, the game would erroneously prevent player A from moving his man. Therefore, at the start of the game, this random data must be cleared from all memory 98 positions.

When the game is first turned on, $\overline{RST}=0$ to select all 32 memory 98 positions, and cause signals W, X and Y to be generated, respectively, to write the memory 98 with signal H and to clear counters 106 and 84, thereby enabling the latter to count clock pulses from fast clock 85. Since $\overline{RST}=0$, counters 230, 232 are not reset after a count of 25 because the clear function is not activated through gates 244, 240. Therefore, counters 230, 232 count through 31 before internally clearing themselves. Thus, all memory 98 positions are addressed and loaded with 0's via cleared counter 106 and the memory write signal H in preparation for loading the game initially. The apparatus for generating $\overline{RST}$ will be described below.

The $2^0$–$2^3$ output of counter 230 is fed to two 4/16 decoders 246 and 248 comprising decoder 90, and the $2^4$ output of counter 232 is applied directly to decoder 246 and via an inverter 250 to decoder 248. Decoder 246 is used to decode positions 0–15 while decoder 248 decodes positions 16–25 on the arrays 14, 16. If $2^4=0$, decoder 246 is enabled; if $2^4=1$, decoder 248 is enabled.

As shown in FIG. 3D, decoder 82, which decodes the count of counter 72, comprises two decoders 252, 254 which receive the $2^0$–$2^3$ bits from the output of counter 200; also, decoder 252 receives the $2^4$ bit of counter 202 directly and decoder 254 receives this bit through an inverter 256. Each decoder 252, 254 also receives the inverted slow clock control signal G from flip-flop 214 via inverter 257 which controls the decoder outputs. When slow clock control signal G=0, decoder 82 outputs are all high and no diodes are lit. When signal G=1, decoder 82 is enabled. If $2^4=0$, decoder 252 is enabled and if $2^4=1$, decoder 254 is enabled.

As shown in FIG. 3C, the output of comparator 70 is fed through an inverter 258 as one input to a NAND gate 260. The other input of this NAND gate 260 is the Q output of flip-flop 262 which has a preset input connected to an OR gate 264 and a clear input receiving the execute signal E. The output of a NOR gate 268 is coupled to a clock input of flip-flop 262 and has one input coupled to the output of decoder 252 decoding the 0 position and another input receiving control signals B. OR gate 264 receives as one input control signal A and another input coupled to the output of the decoder 254 which corresponds to position number 25.

The discussion of FIG. 2 states that the output of comparator 70 is signal C for ease of explanation concerning the basic moves which may be performed by the present invention. However, as shown in FIG. 3C it is the output of NAND gate 260 which is the signal C for reasons which will now become apparent. Since a player can only select one of two numbers on dice 22 this presents a problem near the end of the game. For example, if player A spins a 6 and 5 and has only one man left to move and he is on position 22 this will win the game for player A. In the present game of electronic backgammon if player A selects the die having number 6 the final position will be 28 which does not exist on the console 10. Therefore, the flip-flop 262 and NAND gate 260 will stop the counting of counter 72 at position number 25 in the following manner.

The signal C having a high level is generated when either input to gate 260 is at a low level. Thus, when the game is not drawing to an end and player A reaches a final position, comparator 70 will generate a high output which is inverted by inverter 258, thereby providing a low level as one input to gate 260. Since the execute signal E is generated when player A presses position button 21, the $\overline{Q}$ output of flip-flop 262 is present at this time as a high input to gate 260 and signal C is now generated via flip-flop 262.

When player A has only one man left to move from position number 22 with the dice showing a six and five, a low level will be generated by comparator 70 and, hence, inverter 258 provides a high input to gate 260. With control signal A being generated when a die sheet button 40A, 42A is pressed, OR gate 264 will provide an output to the preset of flip-flop 262 when decoder 254 detects position number 25 to change the state of this flip-flop. Thus, the $\overline{Q}$ output goes low and again signal C is generated indicating position 25 is the final position. In a similar manner, when player B is moving a man to a position which does not exist on the console 10, i.e., a position below the number 0 position, gate 268 will receive two low inputs when position number 0 is decoded to cause flip-flop 262 to switch states, thereby providing a low input to gate 260 and generating signal C thus detecting 0 as the final position.

Multiplexer 96, which sends address signals to the memory 98, selects either the $2^0$–$2^3$ bits from counter 230 or the $2^0$A–$2^3$A bits from adder 193 under the control of signal S. The 4-bit output of mulitplexer 96 is fed as one input to 4 OR gates 272, respectively, the other input of each of these 4 gates being coupled to the inputs $Q_1$–$Q_4$ of a normally cleared register 274. This register is hard wired with a 4 bit code word 1001 to address position number 25 and is used to place a "bumped" man of player B in its "0" position.

A flip-flop 276 has its clock input connected to the output of an AND gate 278 having one input for receiving the control signal A′ and another input for receiving signal F. Flip-flop 276 has its clear input connected to the output of an AND gate 280 having one input receiving the execute signal E and the other input receiving the negative output of fast clock 85. The output of flip-flop 276 is coupled to the clear inputs of register 274 and multiplexer 96. The output of AND gate 278 also is coupled via an inverter 282 to the clock input of register clock 274. In addition to the outputs $Q_1$–$Q_4$, register 274 has a fifth output $\overline{Q_4}$ for memory 98.

Memory 98, as shown in FIG. 3D, comprises four separate memories 284, 286, 288, and 290. Memories 284, 286 store signals corresponding to the number of men on positions 0–15 and 16–25, respectively, for player A. Memories 288, 290 store signals corresponding to the number of men on positions 0–15, 16–25, respectively, for player B. Each of these four memories receives the 4 bit address from OR gates 272 and the data from multiplexer 112. Each of these memories is controlled by the write signal H generated in detector 104 by signal W, and by the output of one of four AND gates 292, 294, 296, 298. These four AND gates receive as one input the signal $\overline{RST}$ (to select all the memories as previously described to clear all random data when the game is first turned on), and as another input the output of a decoder 300 which decodes the particular memory 284, 286, 288 or 290 which must be updated. AND gate 298 also receives the $\overline{Q4}$ signal from register 274 to load a "bumped" man of player B into his "0" position.

Decoder 300 decodes the output of a multiplexer 302 which selects the signal A″ and the $2^4$ bit from counter 202 or the control signal B″ and the $2^4$A bit from register 66 in dependence on the signal S.

For as long as signal S is 1, which is when the circuit is determining if a move is legal, multiplexer 302 selects signal B″ and the $2^4$A bit for decoder 300. If $2^4A=0$, indicating the final position is 0–15, the decoder 300 will decode this to select either memory 284 or 288 storing the number of men for the 0–15, positions of players A or B. If $2^4A=1$, indicating the final position is 16–25, the decoder 300 will decode this to select either memory 286, 290 storing the number of men for the 16–25 positions of players A, B. If B″=0 decoder 300 will decode this to select memories 284, 286 for player A, and if B″=1, decoder 300 will decode this to select memories 288, 290 for player B. Therefore, each of the four memories is selected in accordance with the levels of B″ and $2^4$A when signal S=1.

As already mentioned, when player B is moving, B, B′, B″ are set to 0, and A, A′, A″ set to 1. Therefore, when B″=0 decoder 300 selects memory 284 or 286 which is for the opposing player A when S=1.

The signal S=0 in the normal mode, which is when the circuit is not determining if the move is legal and at this time multiplexer 302 selects signal A″ and the $2^4$ bit from counter 80. In this normal mode, if A″=0, memories 284 or 286 for player A are selected in accordance with the level (1 or 0) of the $2^4$ bit. If A″=1, memories 288 or 290 for player B are selected in accordance with the $2^4$ bit.

The output from one of the memories 284, 286, 288, 290 is fed through four inverters 303 to counter 106 to update by one of the number of men in the position corresponding to this memory output. Counter 106 has a count up input 304 connected to a NAND gate 305 whose one input receives the signal V and whose other input receives the signal C from NAND gate 260. Counter 106 has a count down input 306 connected to the output of an OR gate 307 which also has one input receiving the signal V and the other input receiving the signal C. Counter 106 also has an input receiving signal U, a clear input 308 which receives the signal X and an underflow output 309.

The memory data is inverted by inverters 303 due to the memory characteristics. The inverters are necessary to preserve the data that was entered into each memory. For example, if a 0001 is entered into the memory at a particular position, when recalled out of the memory output it=1110.

Counter 106 is loaded by the signal U. Whatever is in the addressed position of memory 98 at the time signal U is generated is now present at the output of counter 106. For counter 106 to operate properly, when counting up the count down input 306 should be kept high, and when counting down the count up input 304 should be kept high.

During the first cycle of controller 116, signal C=0. If C=0, the count up input 304=1 and the count down input 306 receives the signal V, which will subtract 1 from the count or signal at the output of counter 106. Then, this updated output signal is written into memory 98. During the second cycle of controller 116, signal C=1. If C=1, the count down input 306=1 and the count up input 304 receives the signal V inverted to add 1 to the output signal of counter 106.

The output of the four inverters 303 is also coupled to a register 310 of the legal move detector 104 which is loaded with the data when it receives the signal R. Prior to receiving this data, register 310 is cleared by the execute signal E. The 4-bit output register 310 is fed to a comparator 312 which is hard wired with a binary signal 0001 corresponding to the number 1, and determines whether the number of men in the final position of the opponent is equal to or greater than one. As mentioned above, if this final position is equal to or less than one then the move is legal and can continue; otherwise, the move is illegal and can not continue. If one of the opponent's men is on the final position, comparator 312 provides an output signal on line 314 and this output signal is generated during the second cycle to update the "bumped" man. The timing for the generation of the signal on line 314 is provided by means of a flip-flop 315 which provides an enable or strobe signal over line 316 to comparator 312 and receives the output of AND gate 317 having signals C and X as its two inputs, this flip-flop 315 being cleared by signal E.

Comparator 312 also provides an output on line 313 on the first cycle of controller 116 to prevent signals V and W from being generated when a move is illegal. The output on line 313 is fed as one input to OR gate 318 whose other input is the output of a flip-flop 320 which is cleared with signal E and receives the underflow signal on line 321 from counter 106. OR gate 318 provides an output on line 322 which is fed through an inverter 324 to the error light 47' on the console 10 which indicates that a move is illegal or that an error has been made in selecting a position from which to move a man. Thus, if a move is illegal the output on line 313 is gated through gate 318 to line 322 and then inverted to energize error light 47'. The output on line 322 is also fed to controller 116 to prevent signals V and W from being generated, thereby also preventing the illegal (or erroneous) move from continuing.

A player may make an error by desiring to move a man from, for example, position number 3 which has at least one of his men on it, but incorrectly pushing button 21 for position number 4 which may have no men on it. In this situation, position number 4 will be addressed in the memory 98 for the particular player making the erroneous move, and counter 106 will be instructed to substract 1 from the number of men in this position during the first cycle of controller 116. However, position number 4 will be all "0" since no men for this player are in the selected position; therefore, when "1" is sought to be subtracted an underflow condition is established in counter 106. Counter 106, thus, provides an output on line 321 which causes flip-flop 320 to change state and provide an output which is gated through gate 318 and inverted by inverter 324 to energize error light 47'.

As already indicated, if a man has to be "bumped" it is necessary for controller 116 to cycle through a third cycle. At the end of the first cycle signal C is generated and controller 116 energized for a second cycle to update the final position for the man being moved to that position. During the second cycle, signal X is generated and fed to AND gate 317 which then is enabled to change the state of flip-flop 315 and enable comparator 312 to determine if its input signal from register 310 is equal to 1. If there is an opponent's man to be bumped, the signal on line 314 is generated and fed to a buzzer 328 which is energized for 1 second to warn the players that a man is being bumped. Also, this signal activates a one shot multivibrator 330 which activates another one shot multivibrator 332. The multivibrator 332 activates signal H, via gate 336, which, as will be described, clears the final position of the bumped man and which multivibrator 332 also energizes a one shot multivibrator 334 whose output is the signal F which activates controller 116 for a third cycle to update the bumped man's "0" position.

The manner in which the information stored in memory 98 is updated, when, for example, player A bumps player B's man, will now be described. When player A's move is being updated in memory 98 during the second cycle of controller 116, the comparator 312 output is strobed by the signal on line 316 and the signal level on line 314 goes from 0 to 1 indicating that one man of player B is at the final position. At this time, counter 80 still has the final position stored when the strobe signal is generated (the second cycle is not fully complete, and the fast clock counter 84 is still off), and the counter 106 output is cleared via signal X. Though player A is making a move at which time normally signal $A=A'=A''=0$ and signal $B=B'=B''=1$, the signal on line 314 causes signals $B'=B''=0$ and $A'=A''=1$ to be generated. Therefore, since at this time $S=0$, multiplexer 302 selects signal $A''=1$ and the $2^4$ bit from counter 80 to enable decoder 300 to select the final position of player B from memory 98. Now, all that need be done is to generate write signal H from gate 336 and the final position corresponding to player B will be cleared. This is accomplished by the output of multivibrator 332. The reason for 2 multivibrators 330, 332 is to give sufficient delay after the strobe signal on line 316 is generated for stabilization of, for example, signal $B'=B''$ and the counter 106 output. With counter 106 cleared, and the number of men for player B in the final position being read out from memory 98, this final position is updated and written into the memory when signal H is generated.

After the write pulse H is generated the multivibrator 334 generates signal F to clear counter 80 and start the third cycle of controller 116 to place player B's bumped man in his 0 position. This third cycle occurs before controller 116 generates signal Y in the second cycle so that the counter 80 output remains at all zeroes. When signal F is generated and with $A'=1$ at this time, AND gate 278 enables the output of flip-flop 276 to go high to release the clear input of register 274 and to clear multiplexer 96. The output of gate 278 is also inverted by inverter 282 to clock register 274. As a result, multiplexer 96 selects neither of its inputs, register 274 outputs 1001, and the OR gates 272 output is the address 1001 for memory 98.

With the presence of signal 1001 (corresponding to number 9) at the outputs of gates 272, it is now necessary to select memory 290 since this stores information for positions 16–25 of player b, and add 1 to the number of men at the addressed position to complete the move in which player B's man has been bumped. The $Q_4$ output of register 274 is now at a logical 1 level and this output is applied to decoder 300 which forces all outputs high so that no memory position is selected by this decoder. However, $\overline{Q_4}$ is at a logical 0 since $Q_4=1$ and this causes the output of AND gate 298 to go to 0 and select memory 290. Since the address input $=9$, the $9+16=25$ or zero position of player B is addressed. Thus, when moving a bumped man of player B to the zero position, the address is generated not through counter 80 but through register 274. When the write signal H occurs, $+1$ will have been added by counter 106 to the existing number of men at this addressed position number 25 since signal $C=1$. When the memory is thus updated, player A's move is completed.

Similarly, when player A's man is being bumped, the only thing that changes is that register 274 is not clocked because since player B is moving, initially $B'=0$, $A'=1$, but when the strobe signal on line 316 is generated $A'=0$, $B'=1$. When signal F is generated at this time the output of gate 278 remains 0 because $A'=0$. Now, the address for the memory is 0 and the counter 80 output is conveniently 0 after clearing this counter. The third cycle of controller 116 is generated and +1 is added to the zero position of player A, at which time player B's move is completed.

The reason for gate 280 connected to flip-flop 276 is to enable multiplexer 96 to select the addresses from counter 80 immediately after a player is bumped so that the men may be displayed. After the output of gate 278 clocks flip-flop 276 to clear multiplexer 96, without the negative fast clock input to gate 280, multiplexer 96 will not select its counter 80 inputs to display the men until the next time signal E (the other input to gate 280) is generated by a player depressing a position button 21. Since this may not occur for a relatively long period, the next negative fast clock input to gate 280 after a player's man is bumped causes flip-flop 276 to change states, thereby removing the clear from multiplexer 96 and enabling counter 80 address data to be fed to memory 98.

As shown in FIG. 3D, the 4 bit output from inverters 303 is also fed to decoder/logic 108 which includes a 4/16 decoder 338 to decode its input signal, i.e., the number of men in a given position. The decoded signal is fed to logic 340 which provides a 6 bit output signal on lines 342 to energize a number of diodes in arrays 14, 16 for the position addressed by decoder 90 and corresponding to the information provided by the input signal to decoder 338. Table II shown in FIG. 7B gives the truth table for logic 340. The decoder 338 binary input is shown in the left column, the decoder 338 output in the middle column, and the logic 340 output in the right column indicating the number of diodes to be lit in accordance with the binary input to the decoder.

As shown in FIG. 3E, main decoder cycle controller 116 includes a clock 344 whose output is gated by a NAND gate 346. A counter 348 counts the pulses from gate 346 and this count is decoded by a $\frac{3}{8}$ decoder 350. Counter 348 is cleared by the output signal of a NAND gate 351 whose three inputs are the signals E, C via a one shot multivibrator 352, and F. Decoder 350 provides, sequentially, separated low outputs to OR gates 354, 356, 358, 360, 362 and then NAND gates 364, 366 on lines 355, 357, 359, 361, 363, 365, 367. The other inputs to these gates include, respectively, signal C for gate 354, the strobe signal on line 316 for gate 356, a LNG signal from normally closed switch 36 for gates 358, 360, the signal on line 322 for gate 362 and the $\overline{RST}$ signal for gates 366, 364. The output from decoder 350 to gate 366 is also fed back over line 369 as the other input to gate 346 to stop the controller 116 from cycling through another cycle.

The output of gate 354 is fed as one output to an OR gate 370 whose other input is from normally closed switch 36. The output of gate 370 activates a one shot multivibrator 372 whose output activates another one shot multivibrator 374, the output of which is the signal R. An AND gate 376 receives as one input the output of multivibrator 372 and as two other inputs the outputs of decoders 378, 380 which are, respectively, an OR gate and a NAND gate. Decoder 378 receives the $2^0$A to $2^4$A data from register 66 to decode position number 0 and decoder 380 receives bits $2^0$A, $2^3$A, $2^4$A from register 66 to decode position number 25. Decoders 378, 380 also provide their outputs, respectively, to clear multivibrators 372, 374.

In operation, when a player presses one of the position buttons 21, the low signal E is generated and the output of gate 351 resets counter 348. At this time the counter 348 output is at 000, and a high signal is produced on line 367 since this counter output must be at 111 to have a low output on line 367. Gate 346 is thus enabled to gate clock signals from clock 344 to counter 348 which counts each pulse. Decoder 350 decodes the first count and provides a low signal on line 355. During the first cycle, since signal C has not been generated, the gate 354 provides an output to gate 370. With switch 36 in its normally closed position, gate 370 will gate the output of gate 354 to activate multivibrator 372. Then multivibrator 374 is energized to provide signal R. Gate 376 is also enabled with the output of multivibrator 372 to provide signal S. Multivibrator 374 provides a short delay so that signal S is generated first.

If a player is moving a man into his home position it is not necessary to determine if this move is legal since this is the "0" position of the other player. The move is legal even if the other player has two or more men in such "0" position; therefore, if decoder 378 or 380 provides an output signal in such "0" position, multivibrators 372, 374 are disabled preventing signal R from loading register 310 of legal move detector 104. More particularly, if player A is moving off the board to his home position 25 and player B still has two bumped men in his zero position, there is no rule preventing player A from moving his man to this position. Similarly, the same event could take place at player B's home position where player A has bumped men. Therefore, if the final position is 0 or 25 the memory 98 is not interrogated as to the number of opposing men on that position. This is done by preventing register 310 from being loaded with the data from memory 98.

After the first cycle, signal C is generated to energize controller 116 again for a second cycle. However, signal C also disables gate 354 so that during the second cycle the output on line 355 is not gated to generate signals R and S. Also, when initially loading all the men into the memory 98, the normally closed switch 36 is opened to disable gate 370 so that even though gate 354 gates the signal on line 355 the signals R and S are not generated during initial loading.

After providing a signal on line 355, decoder 350 decodes the next count of counter 348 and provides a low signal on line 357 which is gated by gate 356 as signal T. However, when the strobe signal on line 316 is produced, counter 80 should not be loaded with the count in counter 72; therefore, this signal on line 316 disables gate 356 and signal T is not produced.

Decoder 350 then decodes the next count in counter 348 and provides a low signal on line 359 which is gated through 358 as low signal U, as long as normally closed switch 36 is closed. To provide low signal V, decoder 350 then decodes the next count in counter 348 to provide a low output on line 361 which is gated through gate 360 with switch 36 closed. The output of gate 360 is gated through another OR gate 382 as signal V as long as a high signal on line 322 is not generated. However, when the high signal on line 322 is generated, this disables both gates 382 and 362 to prevent signals V and W from being generated since the move is illegal or erroneous and should not be made. Without the high signal on line 322, signal W is generated when decoder 350 provides a low signal on line 363 when decoding the next count in counter 348.

Signals X and Y are sequentially generated when decoder 350 decodes the next two counts in counter 348 due to low signals being provided on lines 365, 367 and with a high RST signal also being provided as an input to gates 364, 366. The low signal on line 367 is also fed back to gate 346 to disable it and prevent counter 348 from counting any more pulses, thus maintaining fast clock counter 84 activated via signal Y and preventing controller 116 from cycling through again. When one of signals E, C or F is generated, this resets counter 348 to 0, thus providing a high output on line 367 and allowing this counter to start counting pulses again for another cycle.

As shown in FIG. 3E, the signals E, A, A', A", B, B', B" are provided in the following manner. An AND gate 384 has 4 inputs for group signals GS1–GS4 and provides an output to a one-shot multivibrator 386 whose output is the signal E. The output signal E of multivibrator 386 is fed back to its input through a flip-flop 388 whose clear input is connected to the output of AND gate 390.

An AND gate 392 has one input connected to button 32A and another input connected to buttons 40A, 42A. The output of gate 392 is fed to the clear terminal of a flip-flop 394 to provide signal A and as one input to gate 390. Another AND gate 396 has one input coupled to button 32B and its other input to buttons, 40B, 42B. The output of gate 396 is fed to the preset input of flip-flop 394 to provide signal B and as the other input to gate 390. The outputs of gates 392, 396 are also fed, respectively, to the clear and preset inputs of a flip-flop 398 which receives the output signal of comparator 312 on line 314 at its clock input, the outputs of this flip-flop being signals A', B'.

An AND gate 400 receives one input from flip-flop 398 and the output of gate 366 through an inverter 402 as the other input. An OR gate 404 has one input connected to the output of gate 400 and another input connected to the output of a flip-flop 406. An AND gate 408 is connected at its output to flip-flop 406 and receives signals E and Y as its two inputs. The clock input of flip-flop 406 is coupled to the output of gate 244. The output of gate 404 is signal B" and is provided through inverter 406 to generate signal A".

When one of the group signals GS1–GS4 is generated by depressing a position button 21, the output of gate 384 goes low to activate multivibrator 386, thereby producing signal E. When one button 21 is depressed bounce occurs due to metal to metal contact of the button; therefore a number of input signals are present at one input of gate 384 and normally multivibrator 386 would follow these inputs to generate a number of unwanted signals E. However, after multivibrator 386 produces a first pulse, on the positive edge of this first pulse flip-flop 388 is clocked to cause its $\overline{Q}$ output to multivibrator 387 to go low, which maintains this multivibrator in its untriggered position no matter how many pulses are received at its input from the output of gate 384. Flip-flop 388 is cleared, its $\overline{Q}$ output going high, when player A presses one of the buttons 32A, 40A, 42A or player B presses one of the buttons 32B, 40B, 42B, causing the outputs of gates 392 or 396 and gate 390 to go low, thereby enabling multivibrator 386 to be triggered the next time a player presses a button 21.

It will be shown that whenever main controller 116 is cycling, signal A"=A'=A and signal B"=B'=B except in one special case. When buttons 32A, 40A or 42A are depressed, gate 392 is enabled to provide an output to the clear terminal of flip-flop 394, thereby providing signal A=0. When buttons 32B, 40B or 42B are depressed, gate 396 is enabled to provide an output signal to the preset input of flip-flop 394, thereby generating signal B=0. Flip-flop 394 is either cleared or preset so that signal A or signal B remains fixed until the next player moves.

Signal A' or B' is also generated by the output of gate 392 or 396. These signals A', B' are always equal initially to A, B, respectively. However, if a man is going to be bumped, the comparator 312 output on line 314 goes high at the time the strobe signal on line 316 to this comparator is generated. The memory 98 must think the opposing player is moving to bump the opposing player's man; therefore, the comparator 312 output, if the comparator input is 1000, clocks flip-flop 398 to its opposite state. Thus, control signals A', B' change state to allow (1) clearing the bumped man from the final position and (2) updating the zero position with the bumped man, as described previously.

Signal A" and B" always equal signals A' and B', respectively, except when the main cycle controller 116 is stopped. When the controller is stopped, signals A", B" must change periodically to allow the memory position information in memory 98 of each player to be read out to proper data lines to display the positions of all the men. Assume that $\overline{RST}$ to gate 366 is high, which is the case after the players initially load their men into the game. When the signal on line 367 is low, signal Y is high, the output of inverter 402 is low, the output of gate 400 is low and, hence, the input to gate 404 is low. Therefore, the output of flip-flop 406 determines signal B". The fast clock counter 84 is running when the controller 116 is stopped (since the signal on line 367 is low) and counter 80 overflows at a count of 26 decoded by gate 244. Therefore, flip-flop 406 will switch states and this happens every 26 counts so signal B" keeps alternating as does signal A".

If the signal on line 367 is high, the signal Y is low, the preset of flip-flop 406 becomes low via gate 408, the Q output of flip-flop 406 is low, the inverter 402 output is high, the output of gate 400=signal B', and the output of gate 404=signal B'=signal B". Since signal B'=B, hence B'=B"=B.

As an alternative or in addition to the use of thumbwheel switch 34 for initially loading men into memory 98 to start the game, the present invention may include an automatic loader. In FIG. 3D there is shown in phantom lines a multiplexer 412 which receives the outputs of multiplexer 112 and a PROM 114 (Programmable Read Only Memory). Multiplexer 412 is connected to an automatic load switch 416, which may be located on console 10, whereby with this switch closed the PROM data is selected and sent as the data input to memory 98 and with this switch open the data from multiplexer 112 is selected and fed to memory 98.

PROM 414 has permanently programmed in it data for the number of men for each game position which are to be loaded into memory 98 at the start of the game. PROM 414 receives address information from counter 80 and control signal A".

Automatic initial loading is accomplished at the start of the game by turning on a power source (not shown) to activate fast clock counter 84 and counter 80, and closing switch 416. PROM 414 will thus receive addresses from counter 80 and read out addressed data (which is a 4 bit output) to multiplexer 412 for one player due to signal A". As shown in phantom lines at gate 336, there is another input over which pulses from fast clock counter 84 are received when switch 416 is closed. On the positive edge of these pulses counter 80 is incremented by 1 to provide a new address for the counter, and on the negative edge gate 336 goes low to generate write signal H to write the data read out from PROM 414 into memory 98 for the one player. When counter 80 completes the maximum count of 26, signal A" changes to signal B", thereby allowing the PROM to supply memory 98 with data for the other player.

FIG. 3E also shows a flip-flop 420 for generating reset signals $\overline{RST}$ and RST. When the power is first turned on, flip-flop 420 at its preset input PR, receives a low signal before capacitor 422 charges, causing the Q output to go high, and the $\overline{Q}$ to go low, thereby generating, respectively, signals RST and $\overline{RST}$. The signal RST is used to reset all the logic and clear the display on the console while the $\overline{RST}$ signal enables counters 230, 232 initially to count to 32 before being cleared, as described above.

When normally closed switch 36 is opened to load the game initially, a high input is fed to inverter 424 which outputs a low signal to clear flip-flop 420. As a result, RST goes low and $\overline{RST}$ high, thereby releasing all the logic from a forced clear or zero state and enabling counters 230, 232 to be reset after a count of 26 via gates 244, 240. After initially loading the game, switch 36 remains closed and the game proceeds normally. If switch 36 is opened again RST and $\overline{RST}$ remain the same, i.e., low and high, respectively.

There is also shown a normally closed erase switch 426 connected to the clock input of flip-flop 420. This switch is used in conjunction with the automatic initial loading circuit already described. When the game is over, if a player does not want to automatically load the men into their initial positions, the erase switch 462 is operated to clock flip-flop 420, thereby forcing RST high and $\overline{RST}$ low.

FIG. 4 discloses the logic circuitry for controlling energization of the diodes 41A, 43A and 41B, 43B on the console 10. For player A, two flip-flops 428, 430 and a NAND gate 432 control diodes 41A, 43A, and for player B, two flip-flops 434, 436 and a NAND gate 438 control diodes 41B, 43B. These flip-flops are of the "D" type having clear and preset inputs which are high, and a low D input. Spin buttons 38A, 38B are connected to the clear inputs of flip-flops 428, 430, 434, 436. The preset inputs of these flip-flops are connected, respectively, to die select buttons 40A, 42A, 40B, 42B. NAND gate 432 has three inputs for receiving the Q outputs of flip-flops 428, 430 and slow clock control signal G from flip-flop 214. The output of NAND gate 432 is fed to the clock input of flip-flops 428, 430. NAND gate 438 has three inputs for receiving the Q outputs of flip-flops 434, 436 and control signal G. The output of gate 438 is fed to the clock inputs of flip-flops 434, 436.

When button 38A or 38B is depressed, all flip-flops 428, 430, 434, 436 are cleared, causing each Q output to go low. This allows diodes 41A, 43A, 41B, 43B to be energized, but when Q is high there is not sufficient voltage across the diodes to cause any light output. When, for example, player A depresses button 40A or 42A, the corresponding Q output goes high to deenergize the corresponding diode 41A or 43A, thereby indicating the particular die selected.

If neither Q output of flip-flops 428, 430 is low, the output of NAND gate 432 is high and signal G has no effect. If both Q outputs are high, both diodes 41A, 43A are off and when signal G goes high the output of gate 432 goes low. At this point nothing happens since flip-flops 428, 430 at their clock inputs need to go from low to high to transfer their low D inputs to their Q outputs. When the slow clock counter 72 stops counting (because a man has reached the final position), signal G goes low causing the output of gate 432 to go high. This causes the clocking low signal at the D inputs to transfer to the Q outputs causing diodes 41A, 43A to be energized.

Thus, when the dice are spun, two diodes will be energized for each player. When player A selects one die by depressing a die select button, a corresponding light is deenergized. Similarly, when the second die is selected another corresponding diode is de-energized; however, when the second move is completed, i.e., when the man is moved to the final position, both diodes become energized. This is important since if a player spins doubles on the dice, he is entitled to two more moves.

Also, the buttons 38A or 38B automatically light all diodes 41A, 43A, 41B, 43B for both players. If a player could make only one legal move, one diode would be energized, one would be de-energized. When the next player spins, all diodes including the one which may be de-energized are energized. The operation of this FIG. 4 circuitry for player A is the same for player B when buttons 38B, 40B and 42B are depressed.

FIG. 5 illustrates the doubler circuit 122 shown in FIG. 2 for energizing the two seven segment displays 44 comprising a units display 44' and a tens display 44'. Circuit 122 includes a bounceless switch for doubler button 46A comprising NAND gates 440, 442 and a bounceless switch for player B comprising NAND gates 444, 446. A flip-flop 448 has its preset input connected to the output of gate 440 for energizing diode 44A on console 10 and its clear input connected to the output of gate 444 for energizing diode 44B on console 10. A NAND gate 450 receives inputs from gates 440, 444 and provides a clock output for shift register 452.

Shift register 452 has 7 outputs numbered 1–7 and an input received from a NOR gate 454. The shift register outputs are coupled to a number of OR gates 456, 458, 460, 462, 464, 466 and an inverter 468 as shown. Display 44' has three inputs for receiving signals corresponding to the $2^1$, $2^2$, $2^3$ bits, the $2^0$ bit being grounded, and display 44" has three inputs corresponding to the $2^0$, $2^1$, $2^2$ bits, the $2^3$ bit being grounded. Shift register 452 shifts whatever state is present at its input, prior to the clock pulse from gate 450, to output number 1 after receiving the clock pulse. In addition, the output number 1 is shifted to output number 2 when the clock pulse is received, output number 2 shifted to output number 3, etc. Output number 7 is inverted by inverter 468 to clear the register.

Each time a doubler button 46A or 46B is depressed a single clock pulse is fed to register 452, the point value shown by display 44 doubled, and one of the diodes 44A, 44B energized. Assume the shift register 452 has all 0's at its outputs; therefore, NOR gate 454 has two 0's at its inputs and the output of gate 454 is 1. When, for example, player A depresses button 46A, a single pulse is produced from gate 440 due to the bounceless switch to energize diode 44A and generate a single clock pulse from gate 450 to register 452. Therefore, a 1 is shifted to output number 1 and zeroes to all remaining outputs of the register. Now, as will be seen from this circuit, if any output of register 452 is a logical 1, then one input to NOR gate 454 will be at logical 1 and this gate output at logical 0. Therefore, the next input to register 452 will be a 0 and so forth until the 1 is shifted to output number 7 at which time all register outputs will be cleared due to a zero being present at the clear terminal of the register.

With all the outputs of register 452 cleared, display 44 will not be energized. If, at this time, player A, for example, wants to double the points to twice the number being played for, he depresses button 46A causing a logical 1 output from position number 1 which is gated through gate 456 as the $2^1$ bit to show the number 2 on display 44'. Then, if player B wants to double the points now being played for, he presses button 46B, energizing diode 44B, and causing register 452 to shift the logical 1 to position number 2 and inputting a logical 1 to the number 1 position. The logical 1 is now gated from position number 2 through gate 462 and then gate 460 as the $2^2$ bit, thereby energizing display 44' to show the number 4.

As may now be seen, the shifting of the 1 bit through the output numbers 1–6 will energize display 44 to show numbers 2, 4, 8, 16, 32, 64 to indicate doubling of the points. As a further example, if the 1 bit is in position number 5 it is gated through gate 458 and then gate 456 as the $2^1$ bit for the display 44' to show the number 2, and through the gate 458 to the $2^0$ input of display 44'' and through 466 to the $2^1$ input of display 44'' to show the number 3 (1=2).

Figure 6A:
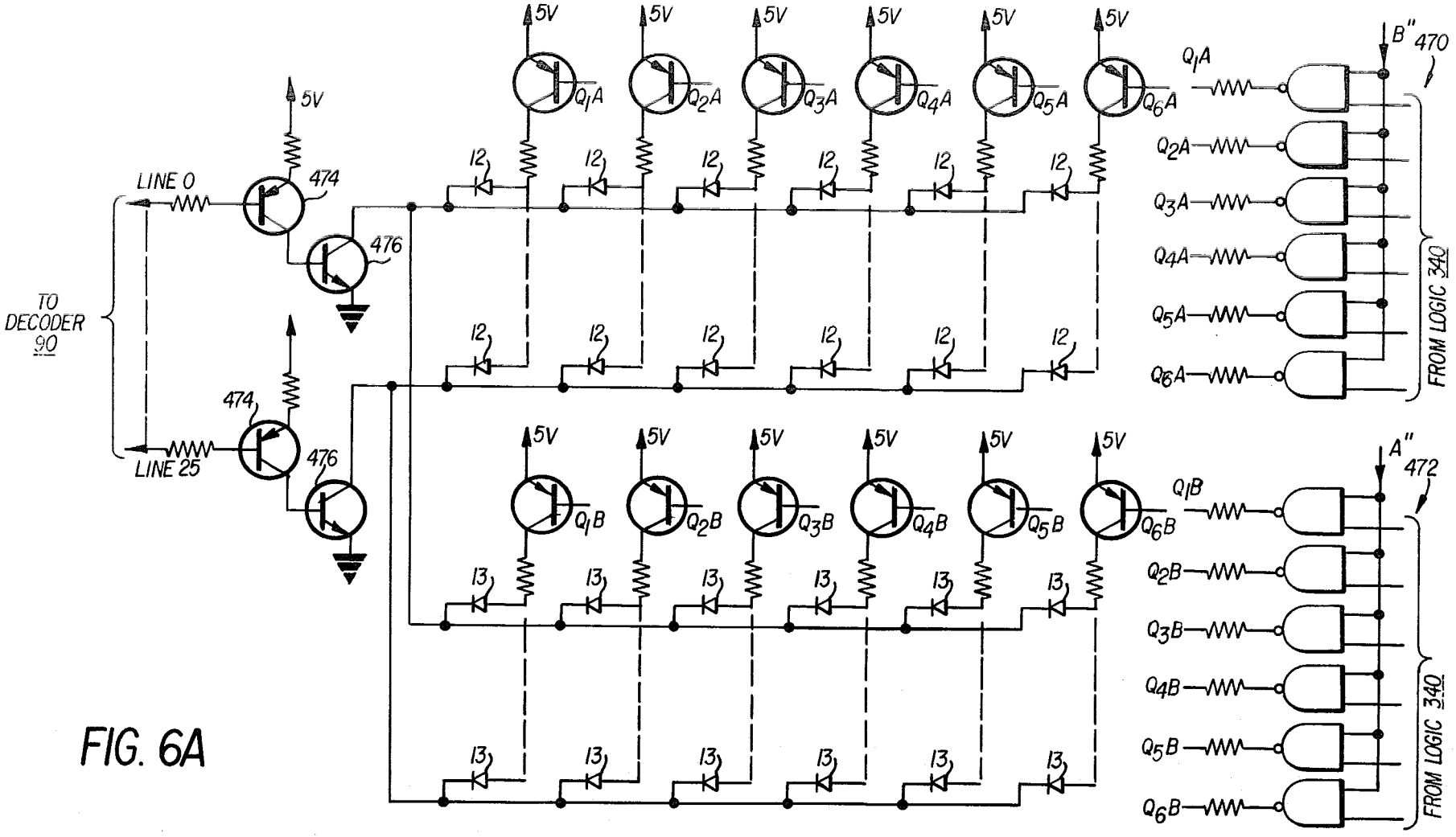
Figures 6B, 7B:
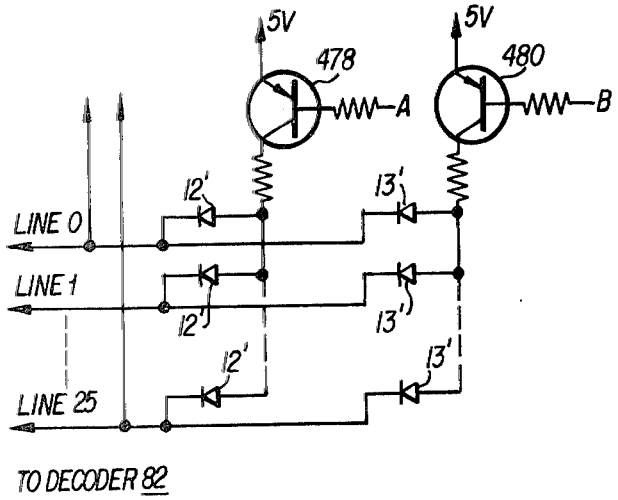

FIG. 6A illustrates in more detail the diode array 14, 16. There are 26 rows of red diodes 12 for player A with 6 diodes per row and 26 rows of green diodes 13 for player B with 6 diodes per row. The red diodes 12 in each row are controlled by 6 transistors $Q_{1A}$–$Q_{6A}$, respectively, and the green diodes 13 in each row are controlled by 6 transistors $Q_{1B}$–$Q_{6B}$, respectively. Transistors $Q_{1A}$–$Q_{6A}$ are biased by the outputs of 6 NAND gates 470, respectively, each having one input receiving signal B'' and the other input receiving, respectively, the 6 outputs from logic 340. Transistors $Q_{1B}$–$Q_{6B}$ are biased by the outputs of 6 NAND gates 472, respectively, each having one input receiving control signal A'' and the other input receiving, respectively, the 6 outputs from logic 340. Each row of diodes is controlled by one of the 26 output lines numbered 0–25 of decoder 90 through transistors 474, 476 for each row.

When fast clock counter 84 is activated and counter 80 is counting, decoder 90 provides signals on output lines 94 to energize sequentially transistors 474, 476. When, for example, a signal is provided on line number 0, and signal B'' is generated, transistors $Q_{1A}$–$Q_{6A}$ in row number 0 are energized in accordance with the data to the gates 470 from logic 340. Thus, for example, if this data indicates that transistors $Q_{1A}$ and $Q_{2A}$ are to be energized, a circuit is closed through these two transistors, their corresponding diodes 12 and transistor 476 in row number 0. In a similar manner, the diodes 12 in the other 25 rows are energized to display player A's men.

When counter 80 has reached a count of 26, it is reset to count from 0 and signal A'' is then generated due to gate 244. Therefore, gates 470 are disabled and gates 472 enabled to control transistors $Q_{1B}$–$Q_{6B}$ in accordance with the data from logic 472. In a similar manner as described above, player B's men are displayed with the green diodes 13.

The current sinking capability of normal logic such as decoder 90 is 16 ma. However, one row of diodes such as row number 0 can have a peak of 1.8 amps if all diodes 12 or 13 are energized. Hence, the current is not drawn through the decoder 90, but through the transistor 476.

FIG. 6B illustrates in more detail the diode array 18, 20 for displaying movement of the men from one position to another. Each diode 12' is controlled by transistor 478 common to all diodes 12' and a respective output on lines 0–25 from decoder 82. Each diode 13' is controlled by a transistor 480 common to all diodes 13' and a respective output on lines 0–25 from decoder 82. Transistor 478 is turned on with signal A and transistor 480 is turned on with signal B. The output of decoder 82 on line 0 is fed to gate 268 and the output of decoder 82 on line 25 is fed to gate 264.

When player A is moving a man, transistor 478 is energized and decoder 82 provides outputs on several of the lines beginning with the initial position selected by player A and sequencing to the final position to energize corresponding diodes 12'. When player B is moving a man, transistor 480 is energized and decoder 82 provides outputs on several of the lines beginning with the initial position selected by player B and sequencing to the final position to energize diodes 13'.

Although the invention is disclosed in detail for the purpose of illustration, it is to be understood that the description is solely for that purpose and that variations can be made therein by those skilled in the art without departing from the spirit and scope of the invention except as it may be limited by the claims.

What is claimed is:

1. A game for playing backgammon electronically, comprising:

(a) a playing board having a plurality of game positions having first light emitting means for representing, when energized, the positions of men for each player;

(b) memory means for storing signals corresponding to the number of men of each player at each of said positions;

(c) means, connected to said memory means, for energizing said first light emitting means;

(d) means, connected to said memory means, for moving a man from an initial position to a final position and for updating said memory means to store new signals as a result of the move;

(e) means, responsive to said stored signals, for preventing a move from occurring if the final position to which one player wants to move a man has a certain number of men of the other player;

(f) second light emitting means, at each of said game positions, for displaying, when energized, movement of a man from said initial position to said final position;

(g) wherein said means for moving and for updating includes (i) means, operable by a player, for generating a first signal corresponding to the number of positions a man is movable, (ii) position encoder means, operable by the player, for generating a second signal corresponding to the initial position from which the man is movable, (iii) counter means, connected to said encoder means, for generating third signals representing said initial and final positions, and for generating fourth signals representing said initial and final positions to address said memory means, (iv) means, connected to said encoder means and said first signal generating means, for logically adding said first and second signals to produce a fifth signal corresponding to said final position, (v) comparator means for comparing said third signals and said fifth signal and for generating a sixth signal when one of said third signals represents said final position, and (vi) means for subtracting one from the signal representing the number of men of the player in the initial position when one of said fourth signals representing said initial position addresses said memory means and for adding one to the signal representing the number of men of the player to said final position in response to said sixth signal and when one of said fourth signals representing said final position addresses said memory means; and (h) wherein said counter means includes (i) a slow clock pulse generator means, and said first counter connected to said slow clock generator means, for counting slow clock pulses to generate third signals representing, respectively, said initial through said final positions, said second light emitting means being responsive to said third signals to be energized sequentially from said initial position to said final position, and (ii) a fast clock pulse generator means, and a second counter connected to said first counter and said fast clock pulse generator means, for counting fast clock pulses commencing with a count corresponding to said final position to generate said fourth signals representing all of said game positions, said first light emitting means being activated in response to said fourth signals representing all of said game positions.

2. A game according to claim 1 wherein said first counter includes an up-down counter which counts up when one player is moving a man and counts down when the other player is moving a man, and wherein said means for logically adding adds said first and second signals when the one player is moving a man and subtracts said first signal from said second signal when the other player is moving a man.

3. A game according to claim 1 further comprising means generating a control signal to enable said second counter to count fast clock pulses only when said memory means is not being updated.

* * * * *

UNITED STATES PATENT AND TRADEMARK OFFICE

CERTIFICATE OF CORRECTION

PATENT NO. : 4,244,578

DATED : January 13, 1981

INVENTOR(S) : Walter Rosenzweig

It is certified that error appears in the above—identified patent and that said Letters Patent is hereby corrected as shown below:

Column 29, lines 18 and 19, after "means," and before "counter" should read -- and a first --.

Columns 26-28 should be added as shown on the attached sheets, but will apply to the Letters Patent only.

Signed and Sealed this

*Thirtieth* Day of *June 1981*

[SEAL]

*Attest:*

RENE D. TEGTMEYER

*Attesting Officer*

*Acting Commissioner of Patents and Trademarks*